US006024556A

United States Patent [19]

Kumazawa et al.

[11] Patent Number: 6,024,556

[45] Date of Patent: Feb. 15, 2000

[54] SPINNERET FOR PRODUCING COMPOSITE POLYMER FIBERS

[75] Inventors: Kinya Kumazawa; Hiroshi Tabata, both of Kanagawa; Shinji Owaki, Aichi; Toshimasa Kuroda, Osaka; Susumu Shimizu; Akio Sakihara, both of Kanagawa, all of Japan

[73] Assignees: Nissan Motor Co., Ltd.; Teijin Limited; Tanaka Kikinzoku Kogyo K.K., all of, Japan

[21] Appl. No.: 09/060,683

[22] Filed: Apr. 15, 1998

[30] Foreign Application Priority Data

| | | | |
|---|---|---|---|
| Apr. 16, 1997 | [JP] | Japan | 9-133038 |
| Apr. 16, 1997 | [JP] | Japan | 9-133039 |
| Apr. 16, 1997 | [JP] | Japan | 9-133040 |
| Oct. 15, 1997 | [JP] | Japan | 9-299360 |
| Oct. 15, 1997 | [JP] | Japan | 9-299361 |
| Oct. 15, 1997 | [JP] | Japan | 9-299362 |

[51] Int. Cl.[7] ..... D01D 5/30

[52] U.S. Cl. ..... 425/461; 425/462

[58] Field of Search ..... 425/461, 462

[56] References Cited

U.S. PATENT DOCUMENTS

| | | | |
|---|---|---|---|
| 5,731,010 | 3/1998 | Kikutani et al. | 425/461 X |
| 5,753,277 | 5/1998 | Kikutani et al. | 425/461 |
| 5,869,107 | 2/1999 | Shimizu et al. | 425/461 X |

FOREIGN PATENT DOCUMENTS

| | | |
|---|---|---|
| 8218218 | 8/1996 | Japan . |
| 8226011 | 9/1996 | Japan . |
| 8226012 | 9/1996 | Japan . |
| 9095817 | 4/1997 | Japan . |

*Primary Examiner*—Leo B. Tentoni
*Attorney, Agent, or Firm*—Klauber & Jackson

[57] ABSTRACT

A composite polymer fiber is produced employing at least two polymer compounds according to a process for producing a composite polymer fiber including the steps of supplying at least two polymer compounds; forming a belt flow by arranging alternately unmixed strips of the polymer compounds supplied; and injecting the belt flow after it is compressed such that the thickness of the belt flow may be longer than the width thereof and that multiple layers of the polymer compounds may be parallel to the longer axis of the fiber. According to this process, there is obtained a fiber having a multilayered structure, in which the thickness of each layer can be controlled with optical accuracy since the multilayered structure is formed in one step, and also having a rectangular cross section in which each layer in the fabric is oriented parallel to the longer axis of the fiber, so that the layers can be easily oriented, when woven into a fabric, in such a direction as to obtain high-intensity coherent beams of light.

29 Claims, 36 Drawing Sheets

SPINNERET FOR PRODUCING COMPOSITE POLYMER FIBERS

BACKGROUND OF THE INVENTION

1. Field of the Invention

The present invention relates to a technique of producing optical functional fibers having light reflecting and interfering functions.

2. Description of the Related Art

Recently, yarns having deformed cross sections instead of simple round cross section are employed so as to satisfy demands for high-quality textures in fabrics. Further, fibers which appeal to the sensibility of people and can express bulky textures and so on by combining two or more kinds of fibers have been developed. However, demands for fabric textures are becoming more and more critical recently, and fabrics having higher expressiveness and facilities are now on demand. What decides texture of a fabric includes color depth and luster. However, it is extremely difficult for fibers to satisfy both color depth and luster simultaneously. More specifically, if one tries to obtain a fiber having a deep color, an unvivid dull-colored fiber is resulted, whereas if one tries to obtain a lustrous fiber, a gaudy glittery fiber is resulted. Accordingly, there is developed so far no technique for producing fibers filly satisfying both color depth and luster.

The reason is that dyes or pigments have conventionally been employed for developing color depth and luster. In this case, since dyes and pigments develop colors based on light absorption, the deeper is the color one tries to obtain, the smaller becomes the reflected light, and luster is lost. On the other hand, the more lustrous is a fiber one tries to obtain, the smaller becomes the light to be absorbed, and color depth is lost.

In view of the problems described above, there is recently proposed a technique for producing fibers having color depth and luster without resorting to dyes and pigments. This technique employs as the color-developing mechanism reflection and coherence of light instead of light absorption as employed in the cases where dyes or pigments are used. Synthetic fibers utilizing this mechanism are also under development.

For example, Japanese Patent Publication No. Sho 43-14185 discloses a coated three-layer composite fiber having pearl effect. However, such fibers having merely some three layers may develop colors based on light reflection and coherence, but the degree of color development is too limited to be able to satisfy the demands for higher expressiveness or sensibility.

Meanwhile, Japanese Patent Publication No. Sho 60-1048 discloses a technique for obtaining a synthetic fiber, in which different kinds of polymers are combined alternately and repeatedly in a spinning pack equipped with a stationary mixer, and the resulting polymer is injected through injection orifices. In this official gazette, there is disclosed a composite fiber consisting of polyethylene terephthalate and nylon 6 formed by layering them via a multilayered film component employing a stationery mixer. This fiber is a multilayered fiber in which the layer interfaces are substantially parallel to one another, and thus the fiber can give textiles having pearl effect. However, in this method, layer flows are disturbed little by little each time two polymers are combined with each other. Although multiple layers can be obtained somehow, they are of such a degree of optical accuracy that it can give sufficient coherence of light, and it is difficult to control the thickness of each layer. Particularly, when a multilayered structure having 10 or more layers is to be formed, fibers must be combined several times or more, so that the layers are liable to have irregular thickness giving coherent beams of light having insufficient intensity and that coherent beams of light having various wavelengths, i.e. turbidity in color, are observed, resulting in the failure of obtaining colors having satisfactory expressiveness or sensibility.

Further, Japanese Patent Publication No. Sho 57-20842 describes a static fluid mixer; and Japanese Patent Publication Nos. Sho 53-8806 and Sho 53-8807 describe methods of spinning blended yarns and the like. According to these methods, fibers are obtained by combining two kinds of polymers and separating them repeatedly, so that they can give no multilayered fiber having sufficient optical accuracy due to complication of the polymer flows, Further, Japanese Unexamined Patent Publication Nos. Sho 62-170510 and Hei 4-202805 disclose methods for obtaining coherent beams of light by forming fine unevenness on the fiber surface. According to these methods, coherence of light is induced by forming a diffraction grating on the fiber. However, it is true that such fibers show color development based on coherence of light, but wavelength of coherent beams of light in fabrics woven by them vary easily depending on the angle of view. Accordingly, in this case, the colors of the fabrics vary only to give cheap expressiveness.

Meanwhile, Japanese Unexamined Patent Publication No. Sho 59-228042, Japanese Patent Publication Nos. Sho 60-24847 and Sho 63-64535, etc. propose color developing fibers and fabrics developed taking a hint from the morpho butterflies in South America which is famous for their variable color tone depending on the angle of view and bright color effect. However, the fibers employed in the inventions described in the above official gazettes are flat yams formed by laminating different kinds of polymers together, so that it is almost impossible to obtain a thickness so as to induce coherence of light, and such structures merely serve to control reflection of light.

Meanwhile, a multi-ply lamination fiber compound of different kinds of polymers is disclosed in Japanese Unexamined Patent Publication No. Sho 54-42421. However, in the method described in this official gazette, the laminated portion is allowed to assume an annular form, and one component in the laminated portion is melted to obtain a superfine fiber. Accordingly, such fibers cannot exhibit the effect of coherence.

Further, Japanese Unexamined Patent Publication Nos. Hei 7-34320, Hei 7-195603 and Hei 7-331532 each propose a technique for obtaining a fiber which is not dyed and yet can develop color and which also has ultraviolet and infrared radiation fleeting function by layering alternately two kinds of polymers having different refractive indices and adjusting the optical thickness of each layer.

Meanwhile, there is also published a technique for obtaining a material which shows color development by employing a sandwich structure of a molecule-oriented anisotropic film between polarizing films (e.g., Journal of Textile Machinery Society, Vol. 42, No. 2, p.55 (1989), and Vol. 42, No. 10, p.160 (1989), ibid.).

Further, Japanese Unexamined Patent Publication Nos. Hei 7-97766 and Hei 7-97786 disclose fiber fabrics each having on the surface a light interference film provided with a substantially transparent thin film layer which can develop color with the aid of the reflected light of incident light from the front surface and the light reflected by the rear surface.

Wavelength of coherent beams of light resorting to such thin films varies depending on the angle of view, so that the color of the fabric changes depending on the angle of view, only to give here again cheap expressiveness as described above.

The present invention is directed to overcome the problems described above and to provide a technique for producing a fiber which develops a single color having both color depth and luster sufficiently.

SUMMARY OF THE INVENTION

In order to obtain the desired fiber as described above, while the fiber should of course have a multilayered structure, it is inevitable that the layers have a uniform thickness. Thus, reflected beans (coherent beams of light) having substantially uniform wavelength can be obtained, so that fabrics woven using such fibers develop very deep colors. The applicant studied correlation between the ply and turbulence in the layers to find that it is essential to form a multilayered structure in one step in order to control the thickness of layers with optical accuracy.

Meanwhile, even if a fabric is woven using a multilayered fiber having layers with a uniform thickness, the fiber cannot always be expected to show single color development so long the adjacent fibers are not oriented. In other words, in order to obtain a fabric which can show single color development, multiplicity of fibers should be oriented in such a direction that is suitable for obtaining coherent beams of light. The applicant further studied which fiber can satisfy such requirements to find that if a multilayered fiber having a rectangular cross section in which each layer is oriented parallel to the longer axis of the fiber is woven into a fabric, the layers in the fabric can be easily oriented in such a direction as to obtain high-intensity coherent beams of light.

The invention to be describe below was accomplished based on the findings described above.

In the present invention, a composite polymer fiber is produced employing at least two polymer compounds according to a process for producing a composite polymer fiber comprising the steps of supplying at least two polymer compounds; forming a belt flow by arranging alternately unmixed strips of the polymer compounds supplied; and injecting the belt flow after it is compressed such that the thickness of the belt flow may be longer than the width thereof and that multiple layers of the polymer compounds may be parallel to the longer axis of the fiber.

Meanwhile, a spinneret for spinning a composite polymer fiber according to the present invention to be employed for realizing this process comprises a belt-like channel and a funnel-like portion having an injection orifice. The belt-like channel, through which one of molten polymer compounds passes, is provided with a plurality of openings, defined in a row orthogonal to the flowing direction of the channel for injecting therethrough another component polymer compound into the belt-like channel; and the funnel-like portion is formed to have reducing faces by increasing the depth of the belt-like channel and reducing the width thereof gradually on the downstream side of the location of the openings defined in a row, while the injection orifice formed at the lower end of the funnel-like portion assumes a form of rectangular slit having a cross-sectional channel profile in which the shorter axis is parallel to the polymer layering direction and the longer axis is orthogonal to that direction.

According to process of the present invention, an appropriate size of belt flow of polymer compounds formed accurately is compressed to form a thin fiber, in which a multiplicity of layers are formed in one step. Therefore, the thickness of each layer can be controlled with optical accuracy. Further, since a fiber having a rectangular cross section in which layers are oriented parallel to the longer axis of the fiber (a flat yarn) can be obtained according to this process, the fiber when woven into a fabric can be oriented in such a direction that coherent beams of light can be obtained most easily (such that the layering direction may be perpendicular to the fabric surface).

Further, a flat yarn to be obtained according to the present invention enjoy an advantage that spinning of the yarn is facile, because the thickness of the fiber can be increased by allowing it to have a high flatness. Since the flat yarn is compressed in the layering direction, layers having an optical thickness of about 0.05 to 0.2 m can be formed easily. Incidentally, the ratio of the longer axis to the shorter axis of this flat yarn is preferably 10 or more, and likewise that of the rectangular slit is preferably 10 or more.

The content of the present invention is not to be limited to the above description. The features of the invention, together with objects, advantages and use thereof, may best be understood by reference to the following description of the preferred embodiments taken in conjunction with the attached drawings. Further, the present examples and embodiments are to be considered as illustrative and not restrictive, and the invention is not to be limited to the details given herein, but may be modified suitably without departing from the spirit of the invention, and such modifications are to be included within the scope of the invention.

BRIEF DESCRIPTION OF THE DRAWINGS

FIG. 3(*b*) is a vertical cross-sectional view taken across the row of openings 107;

FIG. 7(*a*) shows a structure having alternately layered portions as shown in FIG. 6(*a*) and a core S sandwiched between them; and FIG. 7(*b*) shows a structure having shells S on each side of an alternately layered portion;

FIGS. 17*a*–17*e* FIG. 17 show examples of opening rows employable in the spinneret for spinning a composite polymer fiber according to the present invention;

FIG. 20(*a*) is a partially cutaway perspective view; FIG. 20(*b*) is a horizontal cross-sectional view taken across the pipes; and FIG. 20(*c*) is a vertical cross-sectional view taken across the pipes;

FIG. 22(*a*) is a view from the polymer compound inlet side; and FIG. 22(*b*) is a cross-sectional view taken along the line Z–Z' in FIG. 22(*a*);

FIG. 23(*a*) is a view from the polymer compound outlet side; and FIG. 23(*b*) is a cross-sectional view taken along the line V–V' in FIG. 23(*a*);

FIG. 24(*a*) shows a row of openings which are to be combined with another row of openings; FIG. 24(*b*) is a view from the outlet side; and FIG. 24(*c*) is a cross-sectional view taken along the fine W–W' in FIG. 24(*b*);

FIG. 27(*a*) is a vertical cross-sectional view of the fiber; and FIG. 27(*b*) is a perspective view of the fiber;

FIG. 31(*a*) is a vertical cross-sectional view showing a major portion of the spinneret; FIG. 31(*b*) is a cross-sectional view taken along the line T–T' in FIG. 31(*a*); and FIG. 31(*c*) is a cross-sectional view taken along the line W–W' in FIG. 31(*a*);

FIG. 32(*a*) is a plan view; FIG. 32(*b*) is a front view; FIG. 32(*c*) is a cross-sectional view taken along the line X–X' in FIG. 32(*b*); and FIG. 32(*d*) is a cross-sectional view taken along the line Y–Y' in FIG. 32(*b*);

FIG. 34(*b*) is the state after passage of a funnel-like portion;

FIG. 40(*a*) is a plan view; FIG. 40(*b*) is a cross-sectional view taken along the line W–W' in FIG. 40(*a*); and FIG. 40(*c*) is a cross-sectional view taken along the line Z–Z' in FIG. 40(*a*);

FIG. 44(*a*) is a vertical cross-sectional view; and FIG. 44(*b*) is a perspective view;

FIG. 45(*a*) shows a composite polymer fiber having a core S at the center; and FIG. 45(*b*) shows a fiber having shells S on each side;

FIGS. 49*a* and 49*b* FIG. 49 show other examples of openings defined in nozzle plates;

DETAILED DESCRIPTION OF THE PREFERRED EMBODIMENTS

Embodiments of the process for producing a composite polymer fiber and the spinneret employed for the same according to the present invention will be described below referring to the attached drawings.

Figure 1:
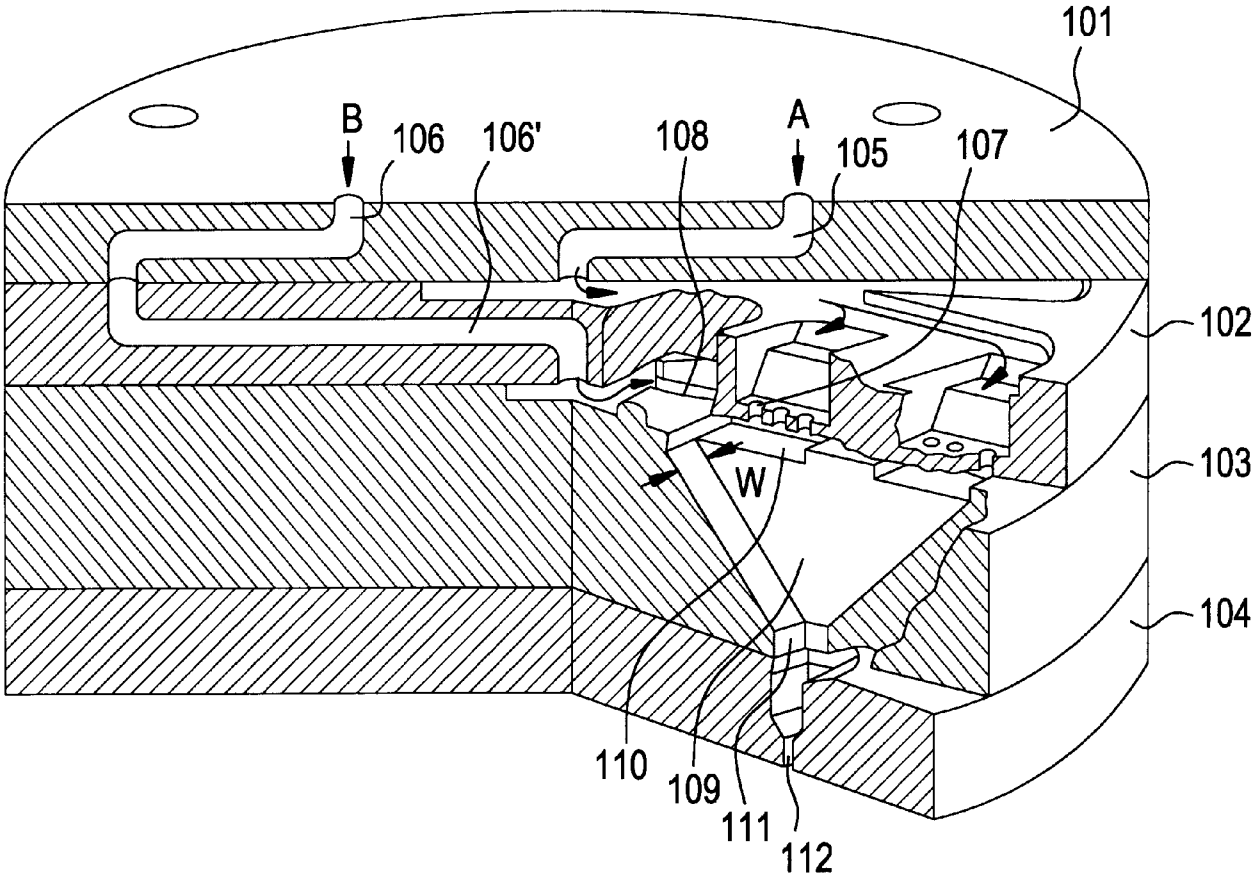
FIG. 1 is a partially cutaway perspective view showing a spinneret for spinning a composite polymer fiber according to one embodiment of the present invention.
Figure 2:
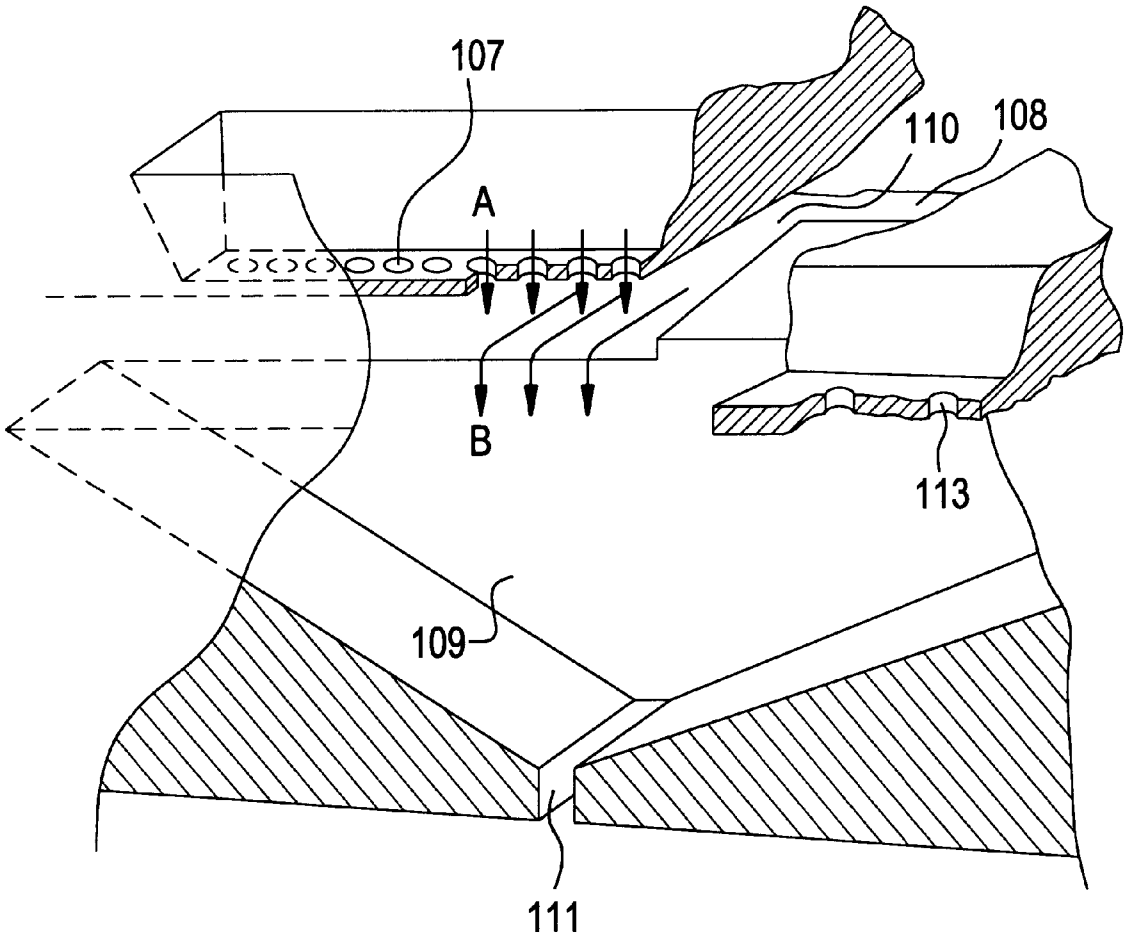
FIG. 2 is an enlarged perspective view of a major portion in FIG. 1.
Figure 3A:
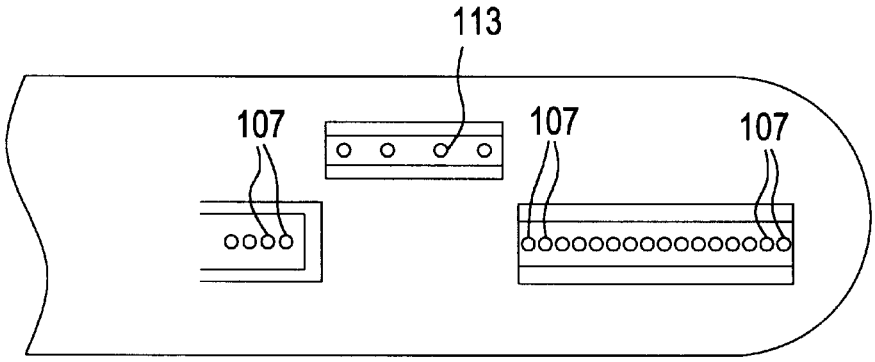
FIG. 3(*a*) is a horizontal cross-sectional view taken across a row of openings 107 shown in FIG. 2.
Figure 3B:
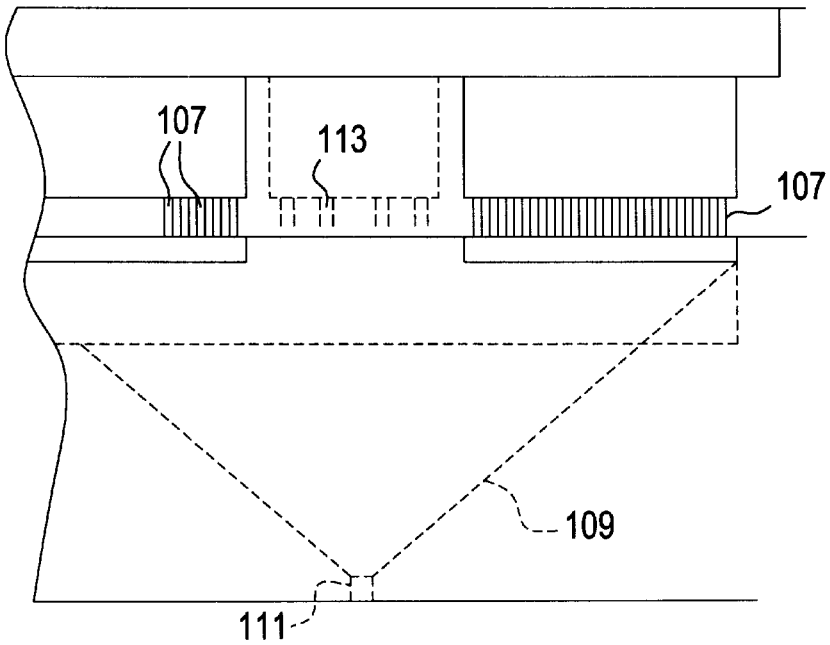

FIG. 1 is a partially cutaway perspective view of a composite polymer fiber spinneret according to the present invention. FIG. 2 is an enlarged perspective view of the funnel-like portion shown in FIG. 1. FIG. 3(*a*) is a horizontal cross-sectional view taken across a row of openings 107, and the upper side of the drawing is a downstream side of the belt-like channel, and FIG. 3(*b*) is a vertical cross-sectional view taken across the row of openings 107. The spinneret consists of four disc-shaped parts, i.e. a distribution disc 101, an upper spinneret disc 102, an intermediate spinneret disc 103 and a lower spinneret disc 104, which are laminated. The distribution disc 101 contains two channels 105 and 106 for supplying two polymer compounds A and B through them respectively.

Meanwhile, the upper spinneret disc 102 contains a channel for introducing the polymer compound A to the row of openings 107 and another channel 106' for introducing the polymer compound B to the center of the spinneret. The polymer compound B introduced to the center of the intermediate spinneret disc 103 flows through a radial channel 108 formed on the upper surface of the intermediate spinneret disc 103 and passes further assuming a form of belt flow over the upper surface of a weir-like portion 110 communicating to a funnel-like portion 109. The weir-like portion 110 is formed parallel to each channel 108.

Thus, the polymer compound A flowing out of the row of openings 107 gets into the belt flow of the polymer compound B passing over the upper surface of the weir-like portion 110 to form a multilayered structure of the polymer compounds A and B which are layered alternately, and the layered polymer compounds A and B flow into the funnel-like portion 109 (see arrows in FIG. 2). The funnel-like portion 109 has a vertical channel profile which is increased in the depth (the dimension in the direction orthogonal to the polymer laminating direction) gradually toward the center and is reduced in the width (the dimension in the polymer laminating direction) gradually downward. The layered polymer compounds A and B passed through this funnel-like portion 109 are discharged through an outlet 111 and then spun through a final spinneret orifice 112 defined in the lower spinneret disc 104.

As described above, since the polymer compound A and the polymer compound B which were layered on the weir-like portion 110 are increased in the depth (in the direction orthogonal to the polymer laminating direction) and are compressed crosswise (in the polymer laminating direction), the polymers maintain a neat layered state. Accordingly, the composite polymer fiber thus obtained can exhibit excellent optical functions. Further, composite polymer fibers having desired layer thicknesses can be obtained by adjusting the bore diameter and intervals of the row of openings 107, enabling emission of light having desired color tone.

Figure 6A:
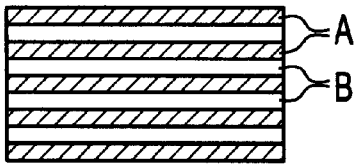
FIG. 6(*a*) is a cross-sectional view of a composite polymer fiber consisting of thin films of two polymer compounds layered alternately, and FIG. 6(*b*) is a perspective view of the fiber.
Figure 6B:
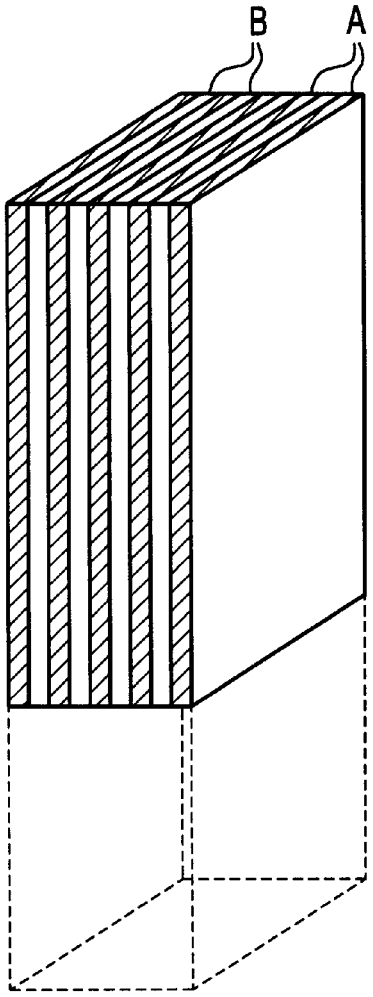
Figure 7A:
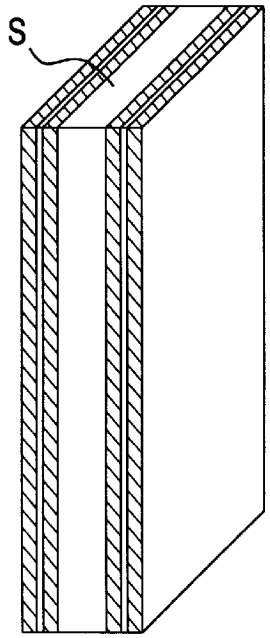
FIG. 7 is a perspective view showing structures of composite polymer fibers.
Figure 7B:
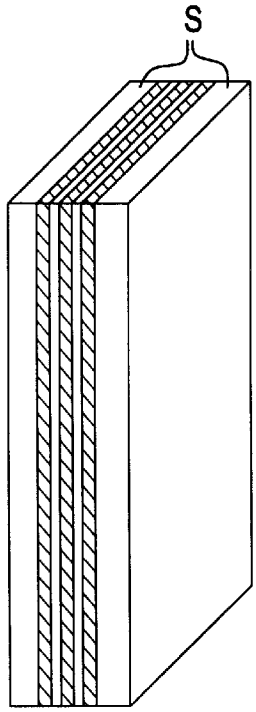

In FIG. 1, the row of openings 107 are formed above the belt-like channel only on each side thereof, and thus a composite polymer fiber having a core S as shown in FIG. 7(*a*) can be obtained. In this composite polymer fiber, as shown in FIG. 7(*a*), since only side portions each assume a form of layered structure consisting of thin films of polymer compounds A and B which are layered alternately, with a single component polymer compound being sandwiched as the core between them, the fiber comes to have an increased strength. The row of openings 107 can be formed only at the central area of the belt-like channel. In this case, a composite polymer fiber having a multilayered body as a core, as shown in FIG. 7(*b*), can be obtained. This fiber also comes to have high strength because of shells formed on each side in place of the core S in FIG. 7(*a*). Incidentally, a fiber as shown in FIG. 6 can be obtained if the openings are formed over the entire width of the belt-like channel.

The number of openings 107 to be formed in rows orthogonal to the belt-like channel is preferably three or more. If it is less than three, the number of layers to be formed will be less than three which is not preferred since the resulting fiber can give neither reflected light having sufficient intensity nor high-quality color development, because it develops different colors depending on the angles of incident light and reflected light with respect to the fiber. Practically, the number of openings is preferably 15 or more and 120 or less. Even if the number of openings is more than 120, the quantity of reflected light cannot be increased any more, but the structure of the spinneret becomes complicated, making the spinning procedures difficult and the spinneret expensive.

The bore diameter of the openings is preferably 0.05 mm or more and 5.0 mm or less. The reason why the lower limit is preferably 0.05 mm is because it is difficult to form openings having bore diameters less than 0.05 mm accurately, and extraneous matters can be inconveniently caught easily in the openings during spinning to induce reduction in the delivery and reduce the thickness of the layers. On the other hand, the reason why the upper limit is preferably 5.0 mm is because it is apprehended that, if the openings have a bore diameter of more than 5.0 mm, the amount of polymer which passes each opening is liable to be insufficient to inject the polymer irregularly, and the width of the row of openings is increased to make it difficult to form multiple layers in the limited space of spinneret.

Meanwhile, the center-to-center distance (pitch) between adjacent openings is preferably 0.2 mm or more and 15 mm or less. If the pitch is less than 0.2 mm, sufficient clearances cannot be secured for the polymer compound which is getting into them to be unable to form layers adequately; whereas if the pitch is more than 15 mm, the opening sections becomes extremely large to increase the size of the spinneret.

In order that the polymer compound A injected through the openings arranged in a row orthogonal to the belt-like channel can get into the polymer compound B flowing through that channel, it is essential that the flow rate of the polymer A is at least twice, preferably four times, as much as that of the polymer B.

The viscosity ratio of the polymer A to the polymer B is also essential. The viscosity ratio of the polymer A to the polymer B is preferably in the range of 0.7 or more to 5.0 or less, more preferably 1.0 or more and 3.0 or less. If the viscosity ratio is less than 0.7, formation of layers will be difficult even if the flow rate ratio is in the range of less than 2; whereas if the viscosity ratio of the polymers is more than 5.0, the viscosity of the polymer B is too high to secure sufficient fluidity, forming unevenness in the layers, unfavorably.

Figure 13A:
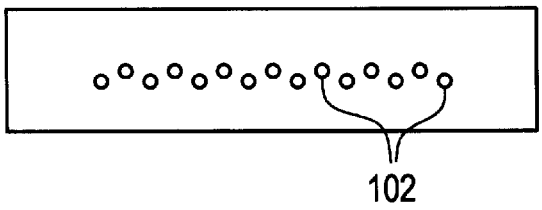
FIGS. 13*a* and 13*b* show other examples of openings defined in nozzle plates.
Figure 13B:
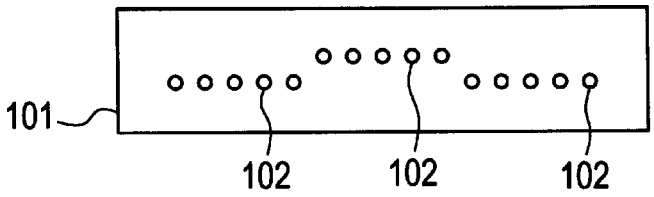

It should be noted here that the row of openings described above may not necessarily be formed linearly but may be staggered slightly from one another as shown in FIG. 13(*a*) or staggered slightly by the block as shown in FIG. 13(*b*), for facilitating machining of fine holes very close to one another.

The spinneret shown in FIGS. 1 to 3 may have no holes 113, and the portion of polymer compound B overflowing the channel 108 may be utilized for forming the core S. However, if injection holes 113 for a core-forming polymer are formed as shown in FIGS. 3(*a*) and 3(*b*) to supply the polymer compound B through a separate channel, supply of the core-forming polymer can be facilitated.

Figure 4:
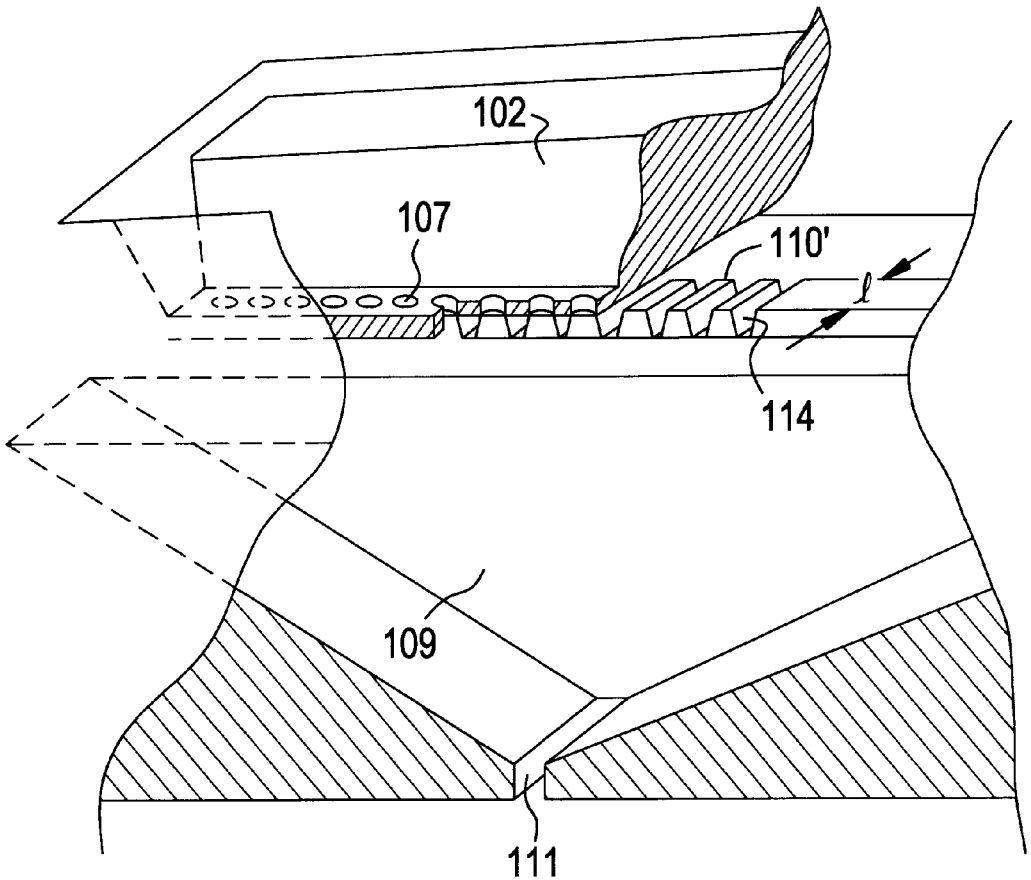
FIG. 4 is a partially cutaway enlarged perspective view of a major portion in a spinneret for spinning a composite polymer fiber according to another embodiment of the present invention.

FIG. 4 shows a spinneret according to another embodiment of the present invention having a toothed weir-like portion 110', and the upper face of each tooth is brought into contact with the upper spinneret disc 102, so that the polymer compound B flows only through channels 114 defined between the teeth. Since the end of the weir-like portion 110' communicates to a row of openings 107 located on prolongation of the teeth, respectively, the polymer compound A and the polymer compound B form a layered structure neatly without mixing.

Figure 5:
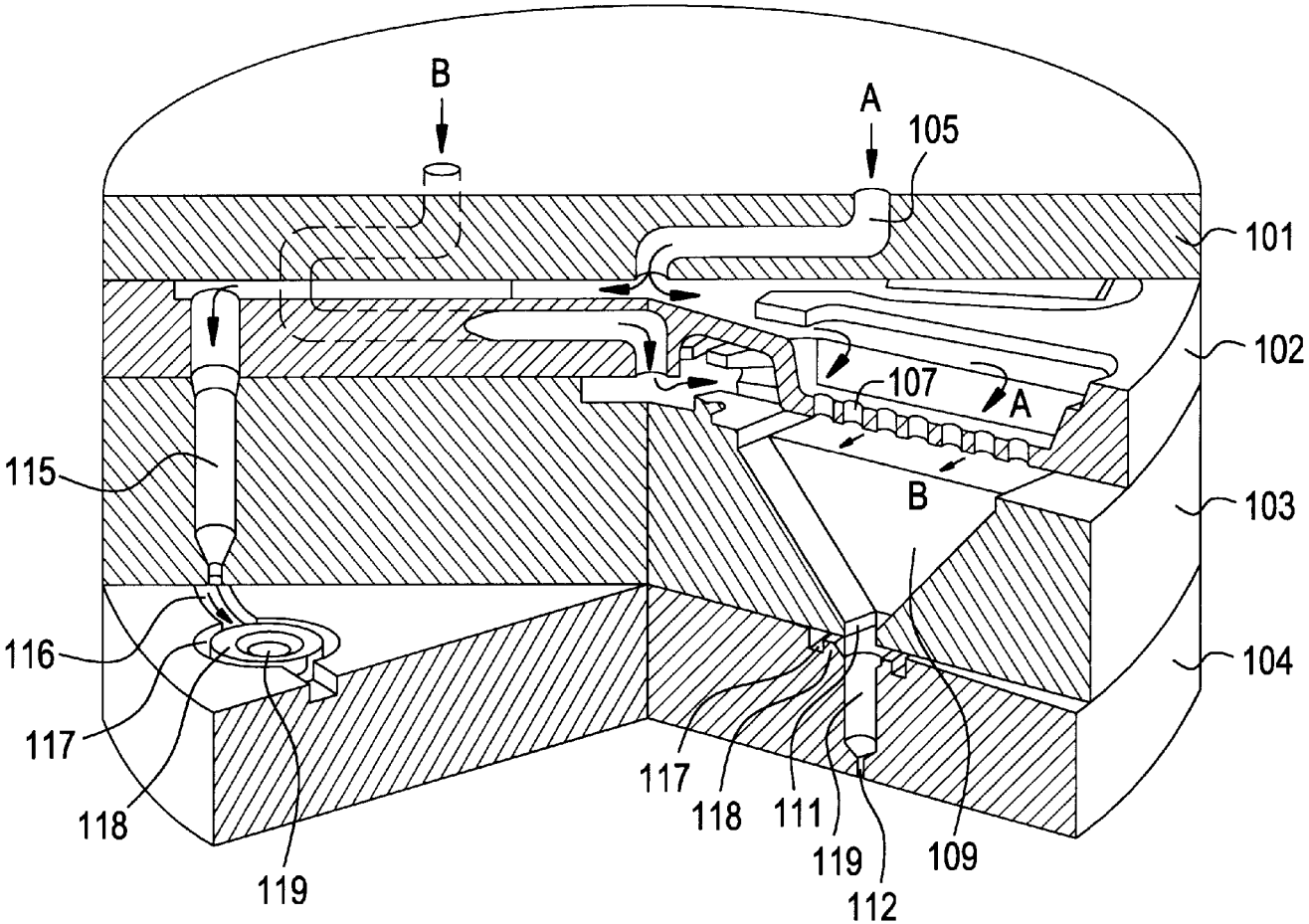
FIG. 5 is a partially cutaway perspective view of a spinneret for spinning a composite polymer fiber according to another embodiment of the present invention.
Figure 8:
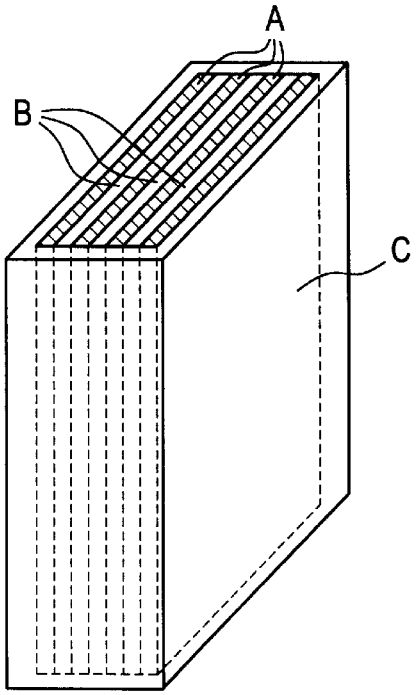
FIG. 8 is a perspective view of a composite polymer fiber having a sheath formed around an alternately layered fiber.

FIG. 5 shows a spinneret according to another embodiment of the present invention. In FIG. 5, a polymer compound A passed through a channel 105 defined in a distribution disc 101 partly passes through a channel 115 to be introduced to a channel 117 formed concentrically around an inlet 119 to the final spinneret orifice, and the polymer compound A further passes over the upper surface of an annular weir-like portion 118 to flow into the inlet 119 to the final spinneret orifice. At this time, an alternately layered body discharged through an outlet 111 flows simultaneously into the center of the inlet 119 to the final spinneret orifice, the multilayered body is surrounded by the polymer compound A to give a fiber having a structure as shown in FIG. 8. Since this fiber has a structure in which the layered portion is surrounded with a shell of single polymer, it is free from layer separation and exhibits high strength.

Figure 14:
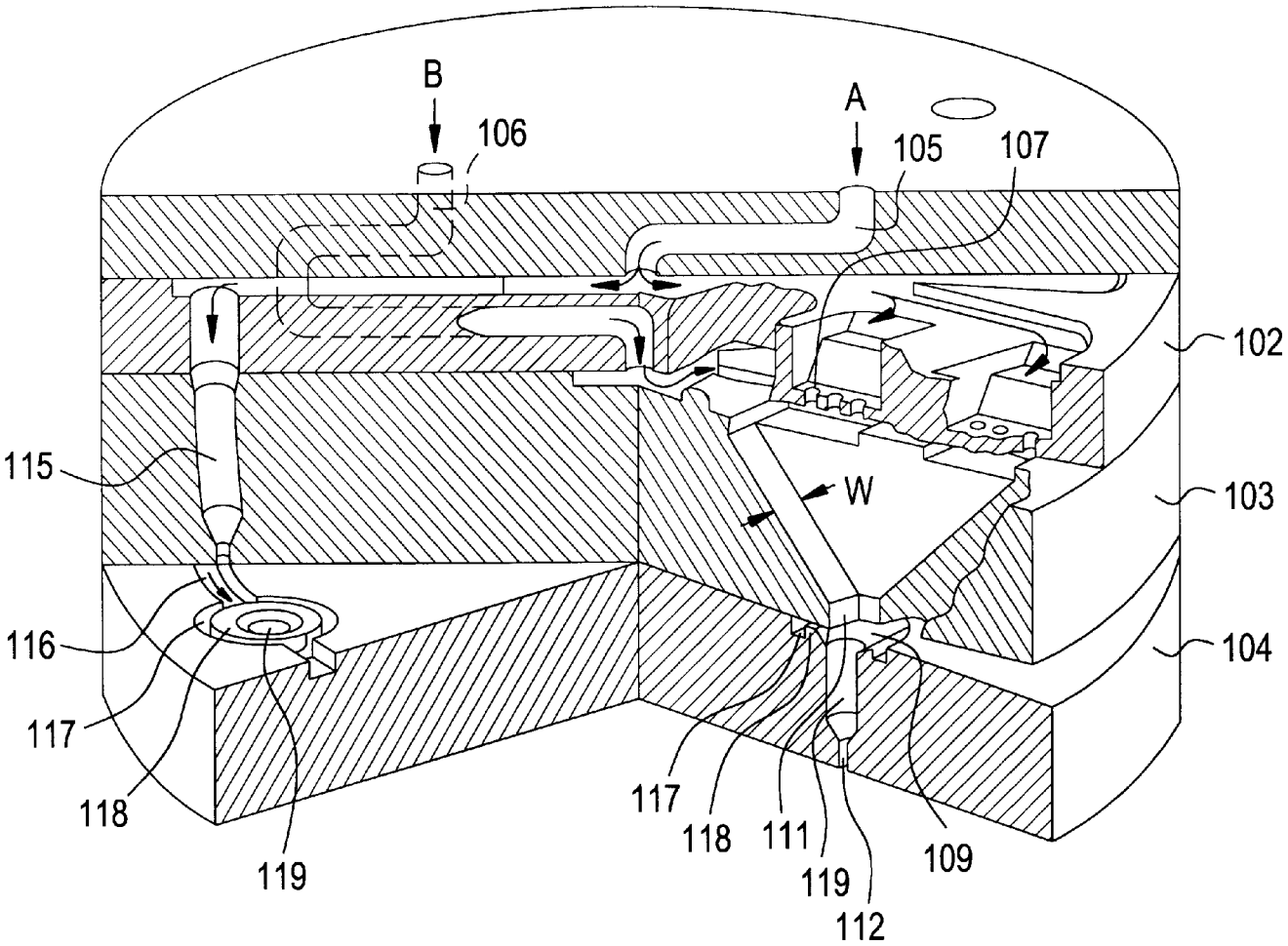
FIG. 14 is a partially cutaway perspective view of a spinneret for spinning a composite polymer fiber according to another embodiment of the present invention.
Figure 15:
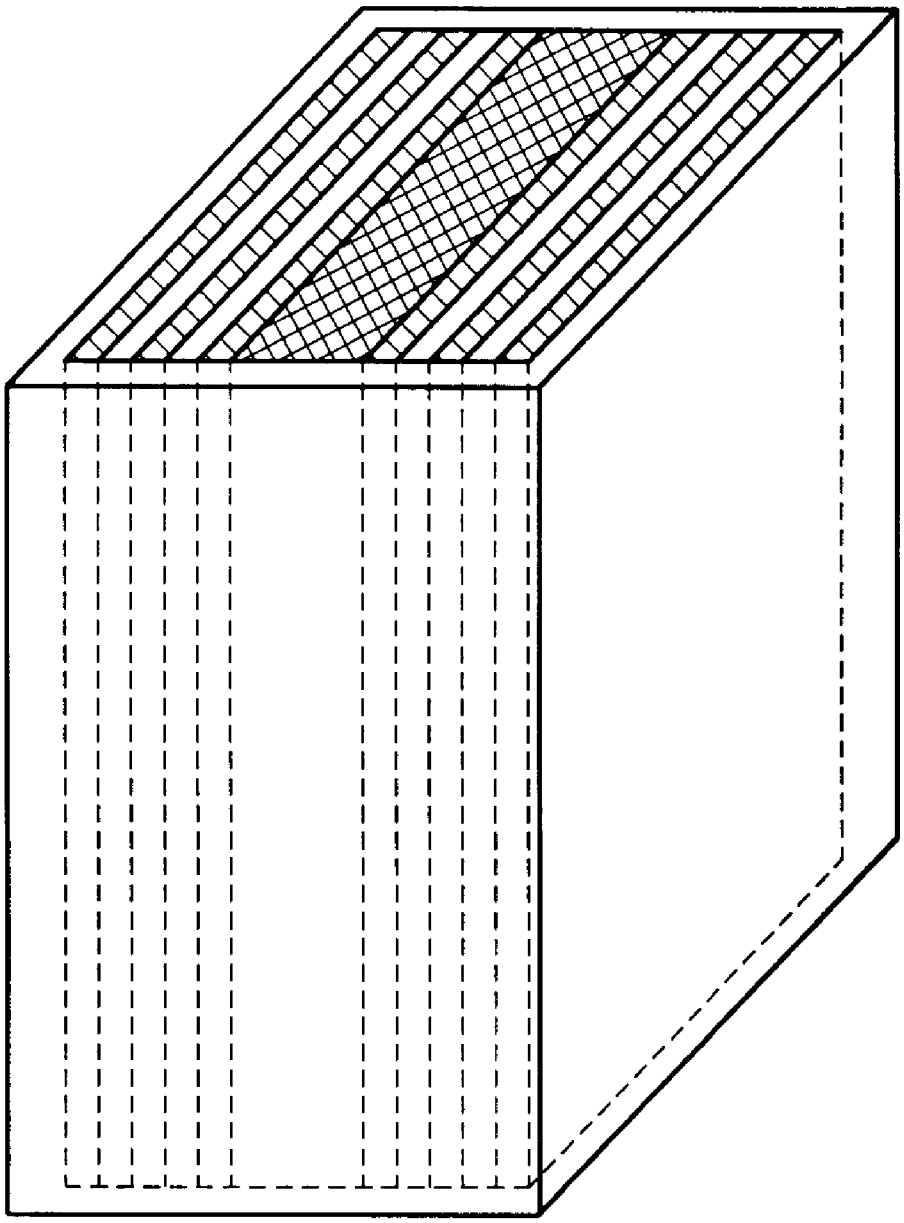
FIG. 15 is a perspective view of a composite polymer fiber having a core S at the center of the fiber and a sheath surrounding the fiber.

As another embodiment of the present invention, a spinneret which is a combination of the embodiment of FIG. 1 and that of FIG. 5 is shown in FIG. 14. By use of such a spinneret, a fiber having a structure as shown in FIG. 15 can be obtained as a combination of the structure shown in FIG. 7 and that shown in FIG. 8.

TEST EXAMPLE 1

A composite polymer fiber was spun using the spinneret shown in FIG. 1. The spinneret had a row of openings 107 above the belt-like channel on each side thereof. Each row contained 15 openings 107 having a bore diameter of 0.15 mm formed at a pitch of 0.4 mm. Core-forming polymer injection holes 113 each having a bore diameter of 0.28 mm were formed on the downstream side of the row of openings 107, as shown in FIG. 3. The clearance between the upper surface of the weir-like portion 110 and the disc containing the openings 107 was 0.15 mm. The funnel-like portion 109 had a thickness W of 2.5 mm, and a compression rate of 90%, and compression was carried out linearly. The final spinneret orifice 112 had dimensions of 0.14 mm×2.1 mm, in which the sides having a length of 0.14 mm were oriented orthogonal to each film (in the layering direction).

Figure 9:
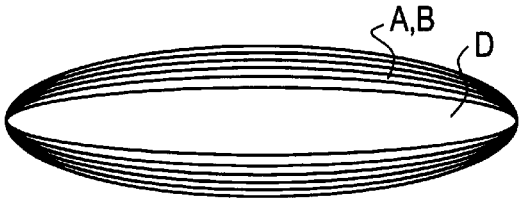
FIG. 9 is a cross-sectional view of a fiber obtained in Test Example 1.

Nylon 6 ([η]=1.3) was used as the polymer compound B to be supplied to the channel 106 and supplied at a rate of 4 g/min. A polyethylene terephthalate copolymerized with 1.5 mol % of sodium sulfoisophthalic acid component ([η]=0.48) was used as the polymer compound A to be supplied to the channel 105 and supplied at a rate of 12 g/min. Spinning was carried out at a spinneret temperature of 280° C. to take up the resulting fiber at a spinning rate of 1200 m/min. The fiber had a flatness of 4. The fiber was then supplied to rollers heated to 80° C. to be oriented at a draw ratio=2.0. The thus oriented fiber had a fineness of 60 denier and a cross section as shown in FIG. 9, and the thickness of the shorter axis of the core D was about 30% of the entire thickness. The resulting fiber developed colors ranging from red to green and had a strength enough to be subjected to treatment over a knitting machine or a textile machine.

TEST EXAMPLE 2

Figure 10:
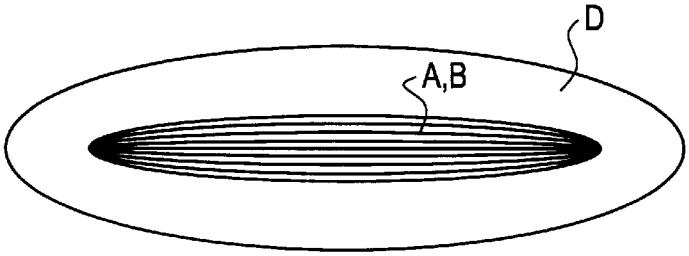
FIG. 10 is a cross-sectional view of a fiber obtained in Test Example 2.

A composite polymer fiber was spun using the spinneret shown in FIG. 5. The spinneret had 35 openings 107 having a bore diameter of 0.15 mm formed in a row at a pitch of 0.4 mm. Polymethyl methacrylate (MFR=14,230° C.) was supplied as the polymer compound B at a rate of 4 g/min; whereas a polycarbonate (viscosity =900 poise, 280° C.) was supplied as the polymer compound A at a rate of 12 g/min to carry out spinning at a spinneret temperature of 280° C. and at a spinning rate of 2000 m/min. The fiber thus obtained had a fineness of 72 denier and a cross section as shown in FIG. 10, and it showed substantially green clear color development.

Comparative Example 1

Figure 11:
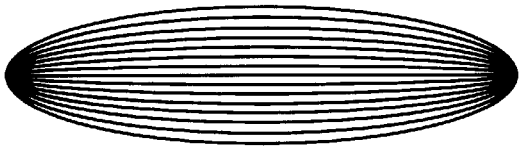
FIG. 11 is a cross-sectional view of a fiber obtained in Comparative Example 1.

A composite polymer fiber having a cross-sectional structure as shown in FIG. 11 was obtained in the same manner as in Test Example 1 except that a spinneret having 35 openings 107 arranged linearly and continuously and having no core-forming polymer injecting hole 113 was employed.

Figure 12:
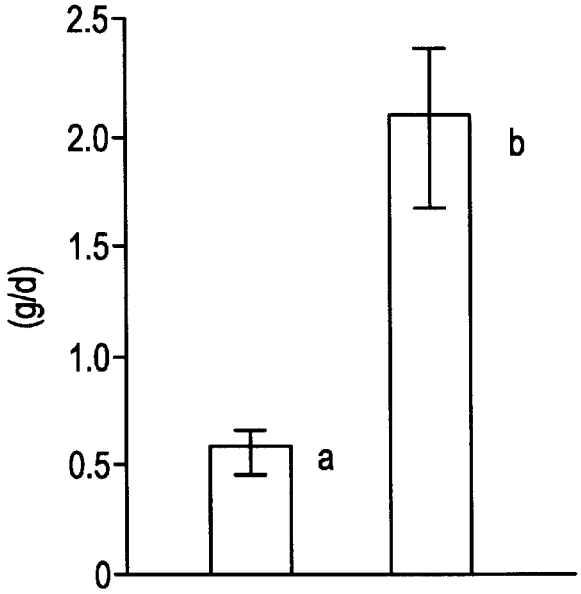
FIG. 12 is a chart showing tensile strength measured for the fiber obtained in Test Example 1 and that obtained in Comparative Example 1.

Tensile strength of the fiber obtained in Comparative Example 1 and that of the fiber obtained in Example 1 were measured, and the results are as shown in FIG. 12, in which a represents the fiber obtained in Comparative Example 1 and b represents the fiber obtained in Test Example 1. The strength of the alternately layered fiber of Test Example 1 having a core S was extremely higher than that of the fiber having no core S.

TEST EXAMPLE 3

Figure 16:
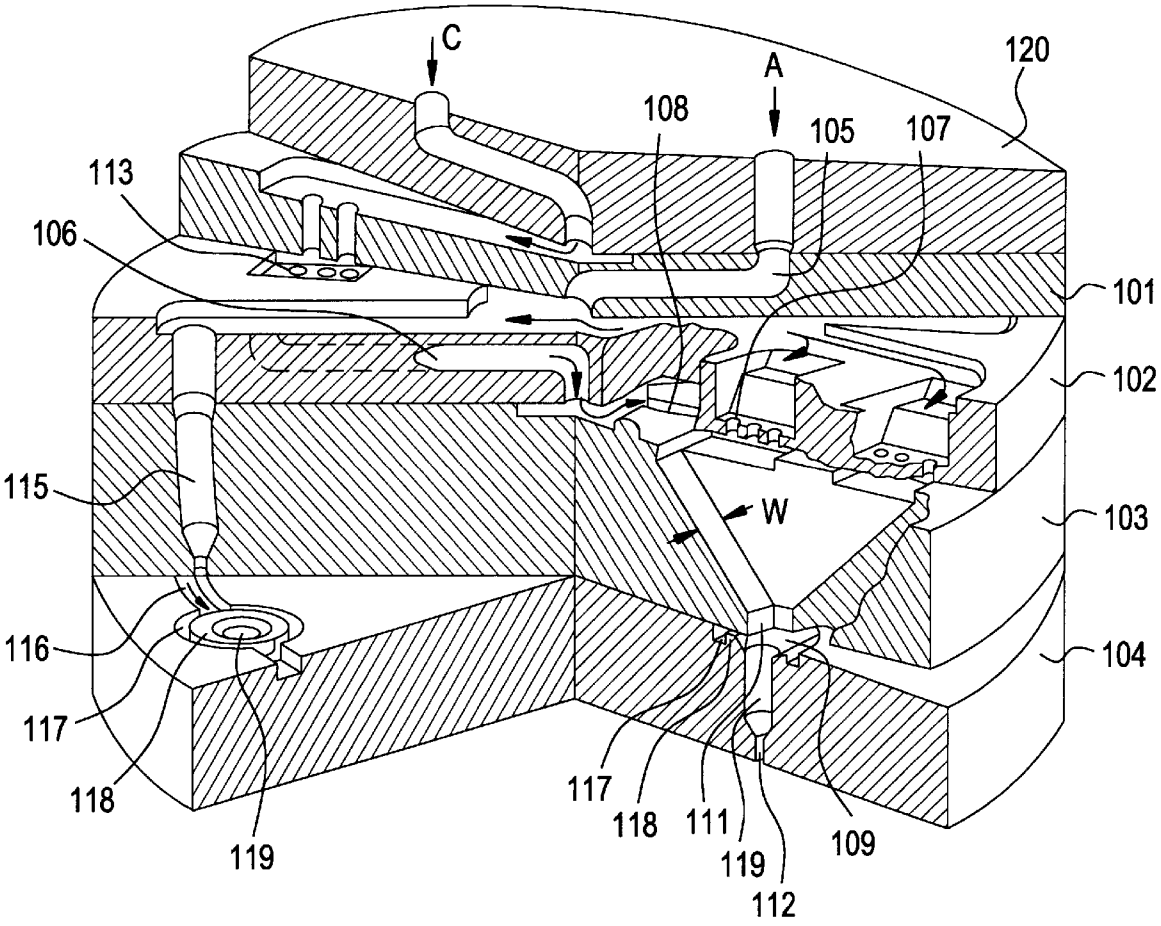
FIG. 16 is a partially cutaway perspective view of a spinneret for spinning a composite polymer fiber employed in Test Example 3.
Figure 17A:
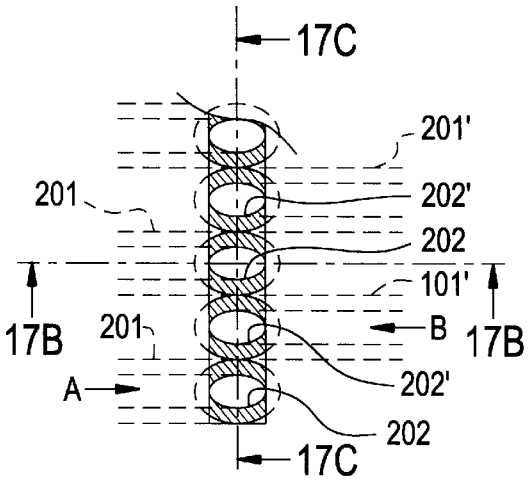
Figure 17B:
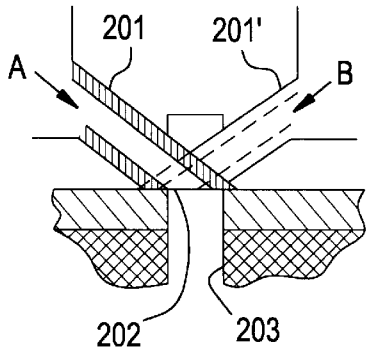
Figure 17C:
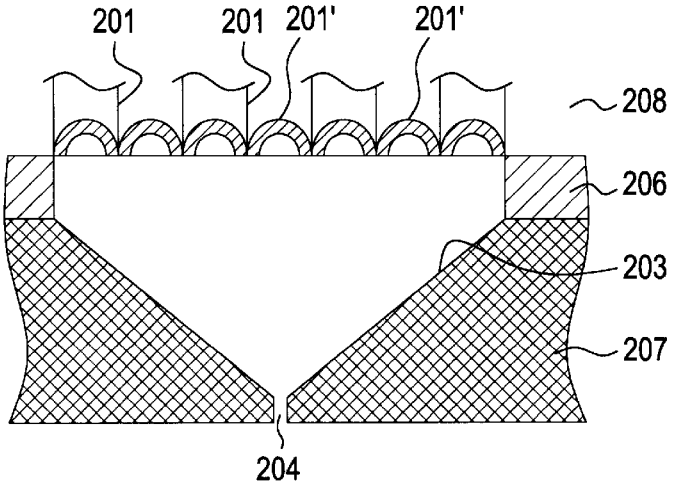
Figure 17D:
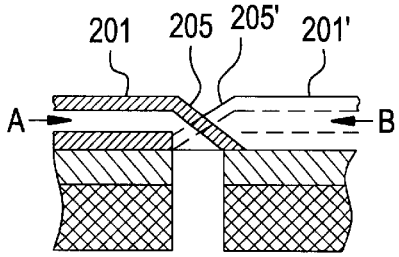
Figure 17E:
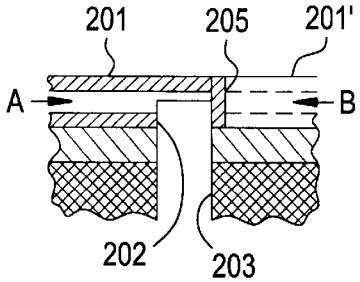

Three kinds of polymers were subjected to spinning using the spinneret shown in FIG. 16. It should be noted that an additional distribution disc having a channel for supplying a third polymer C was disposed on the distribution disc, and the polymer C was introduced to the opening 113.

Fifteen openings 107 having a bore diameter of 0.15 mm were formed in a row above the belt-like channel on each side thereof at a pitch of 0.4 mm. Four core-forming polymer injecting holes 113 having a bore diameter of 0.38 mm were defined as shown in FIG. 3. The clearance between the upper surface of the weir-like portion 110 and the disc containing the openings 107 was 0.15 mm. The funnel-like portion 109 had a compression rate of 90%, and compression was carried out linearly. The spinneret orifice 112 had dimensions of 0.125 mm×2.5 mm and a straight length of 0.4 mm.

Polyethylene naphthalate was supplied as the polymer compound B through channels (not shown) defined in the top distribution disc 120 and in the distribution disc to the channel 106 at a rate of 5 g/min; nylon was supplied as the polymer compound A to the channel 105 at a rate of 15 g/min; and a mixture of polyethylene terephthate and an oxide dispersed therein was supplied as the polymer compound C to the holes 113 at a rate of 10 g/min. Spinning was carried out at a spinneret temperature of 278° C. at a the take-up rate of 1500 m/min and with a draw ratio of 2.1.

The fiber obtained had a structure as shown in FIG. 15 consisting of the mixture of polyethylene terephthalate and an oxide constituting the core S, a nylon sheath and alternately layered portions between the core S and the sheath. This fiber showed bright red color development.

FIG. 17 shows some examples of other types of opening rows employable in the composite polymer fiber spinning spinneret according to the present invention. FIG. 17(*a*) is a side view of an example of serrated openings viewed from the molten polymer outlet side; FIG. 17(*b*) is a cross-sectional view taken along the line X–X' of FIG. 17(*a*); and FIG. 17(*c*) is a cross-sectional view taken along the line Y–Y' of FIG. 17(*a*).

Figure 18:
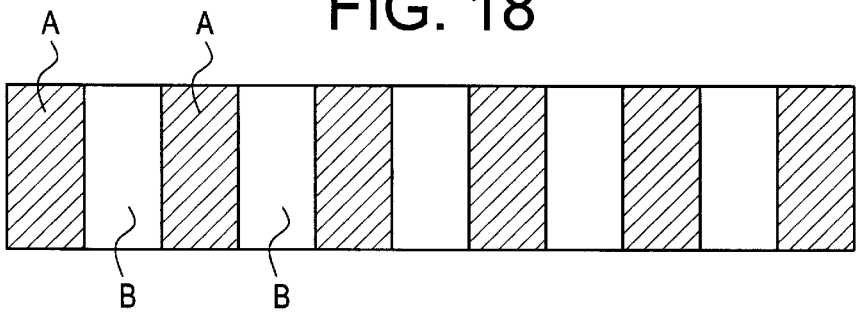
FIG. 18 is a cross-sectional view showing a state of two kinds of polymer compounds immediately after injection through the rows of openings.
Figure 19:
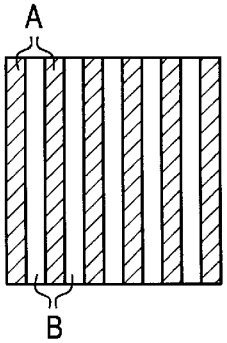
FIG. 19 is a cross-sectional view showing a state to be assumed by the polymer compounds shown in FIG. 18 after they are passed through a funnel-like portion.

A row of pipes 201 for injecting a molten polymer A are arranged to intersect diagonally with a row of pipes 201' for injecting a molten polymer B, and openings 202 through which the molten polymer A is injected and openings 202' through which the molten polymer B is injected are aligned alternately and linearly. While the flow of the molten polymers A and B injected from these openings 202 and 202' form a cross-sectional structure as shown in FIG. 18, the molten polymers A and B are compressed when they pass through a funnel-like portion 203, and the resulting fiber spun through a fiber injecting orifice 204 assumes a cross-sectional structure as shown in FIG. 19.

Since the thus obtained composite polymer fiber consists of very thin layers and has distinct layer boundaries, it can exhibit excellent optical functions.

FIGS. 17(*d*) and 17(*e*) are variations of the above embodiment and each has a cross section similar to that in FIG. 17(*b*). The pipes 201 and pipes 201' for injecting molten polymers are arranged opposedly on the same plane to be parallel to one another. The pipes 201 and 201' have closed ends 205 and 205' and side openings 202 and 202', respectively. Incidentally, the row of openings described above may not necessarily be arranged linearly but may be staggered slightly from one another or may form a plurality of rows arranged slightly staggered so as to facilitate machining of fine openings, and the same shall apply to the following examples.

Figure 20A:
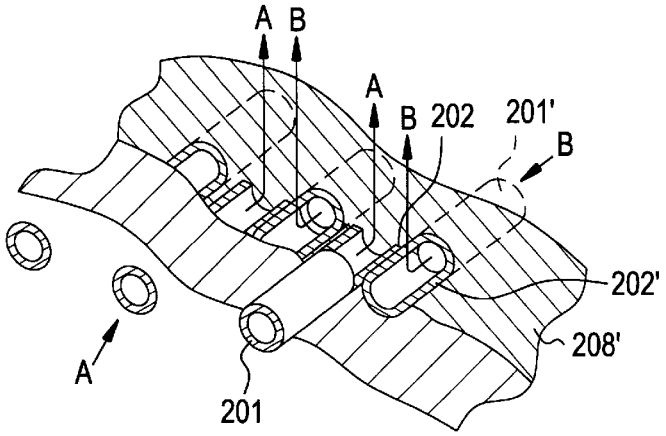
FIG. 20 shows another example of opening row employable in the spinneret for spinning a composite polymer fiber according to the present invention.
Figure 20B:
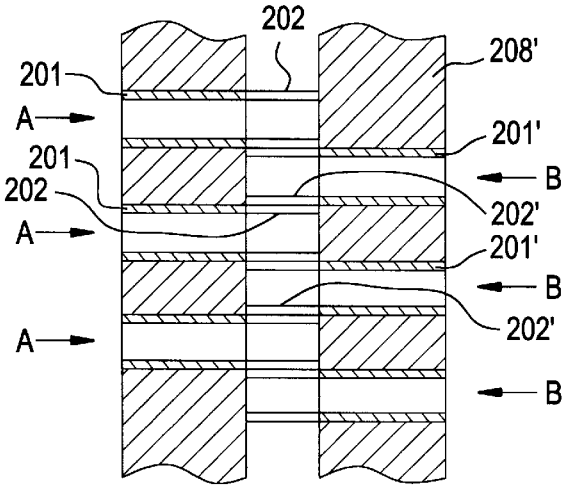
Figure 20C:
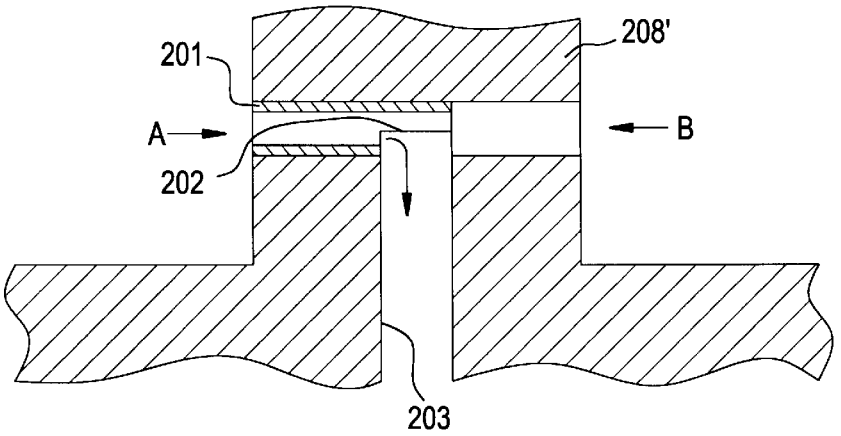

FIG. 20 shows another variation of the example shown in FIG. 17(*e*). FIG. 20(*a*) is a partially cutaway perspective view of the openings 202 and 202' viewed from the outlet side; FIG. 20(*b*) is a horizontal cross-sectional view of the pipes 201 and 201' viewed from the outlet side; and FIG. 20(*c*) is a vertical cross-sectional view of a pipe 201 taken along the longitudinal direction thereof.

In this variation, the pipes 201 and 201' for injecting molten polymers are not arranged on the upper surface of the intermediate spinneret disc 206 but are embedded horizontally in a perpendicular wall 208' formed on the upper spinneret disc 208.

Figure 21:
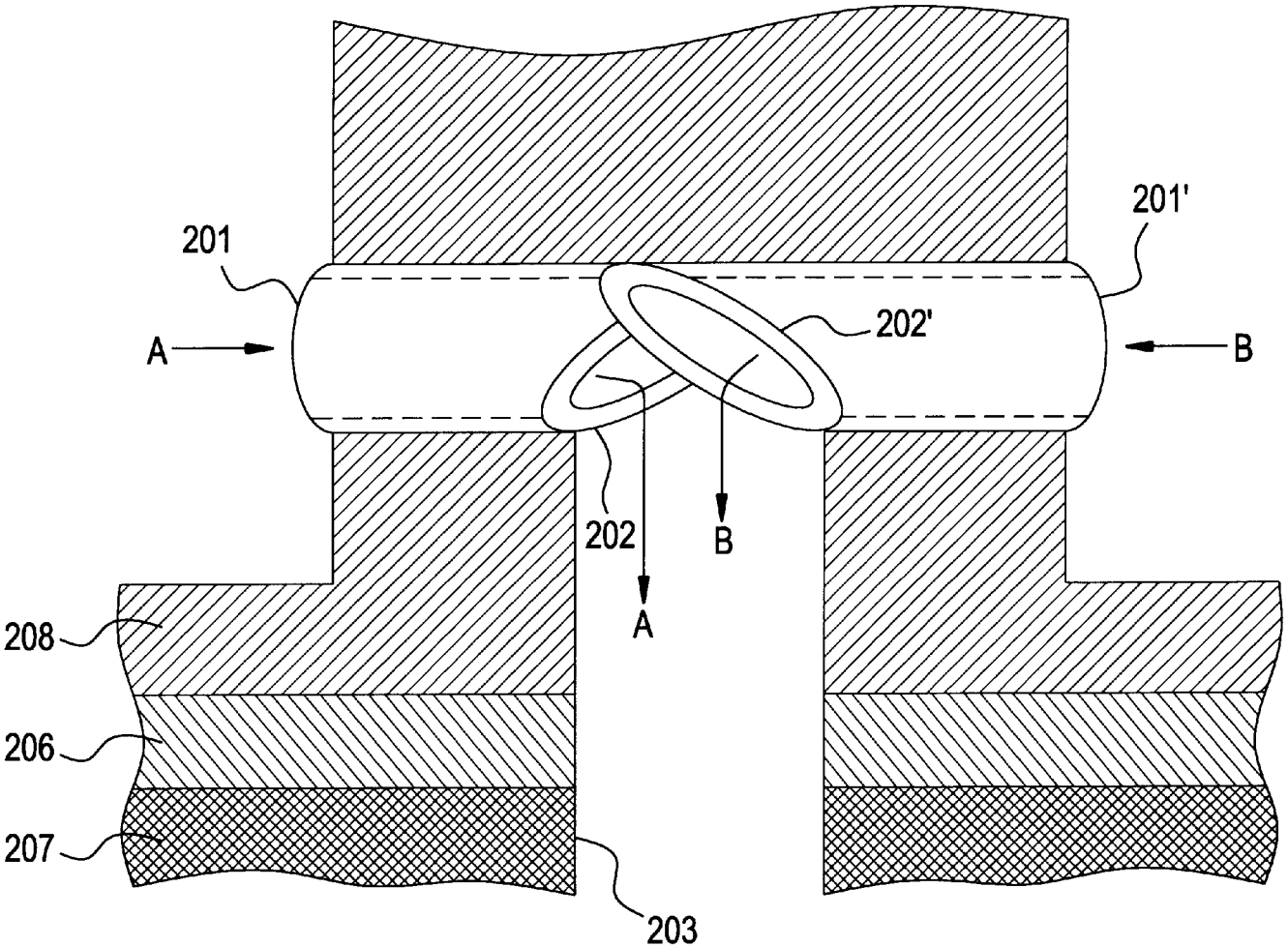
FIG. 21 shows another example of opening row employable in the spinneret for spinning a composite polymer fiber according to the present invention.

FIG. 21 shows another example. As shown in FIG. 21, the openings 202 and 202' may be formed by cutting the pipes 101 and 101' diagonally. In FIG. 21, the reference numbers 206, 207 and 208 correspond to the counterparts in FIG. 17(*c*).

As described above, while the row of openings in the present invention can be formed by the general machining procedures, they can be formed easily by arranging pipes parallel to one another at predetermined intervals in two groups such that these pipe rows may intersect with each other and by cutting the pipes at the intersections to form rows of openings.

While the manner of intersecting the pipes and the profile of the openings formed by cutting the pipes are not particularly limited, two groups of pipes may be intersected diagonally to be cut diagonally and form ellipsoidal openings or may be intersected so that the front ends of the pipes of each group may be aligned to form circular openings.

Figure 22A:
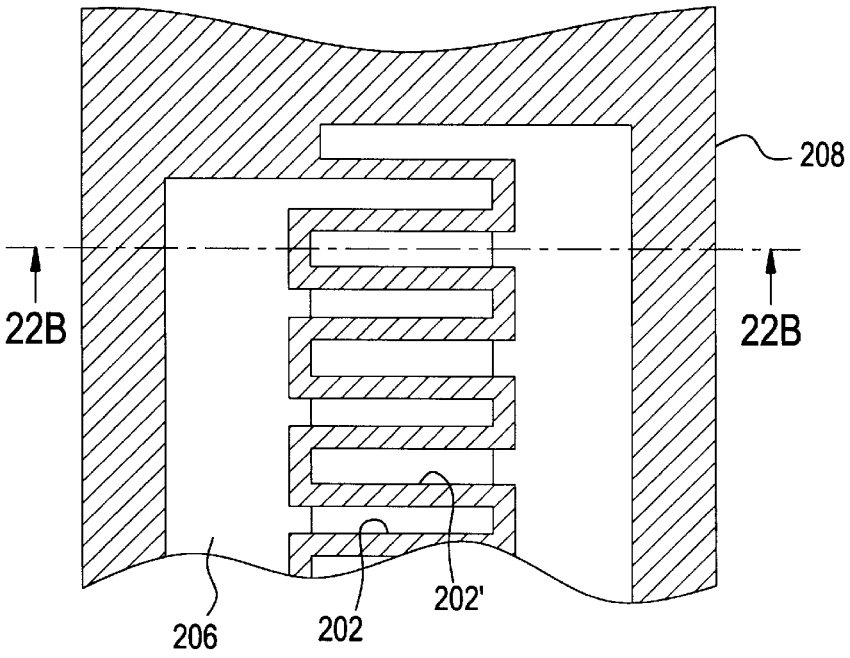
FIG. 22 shows another example of openings in the spinneret for spinning a composite polymer fiber according to the present invention.
Figure 22B:
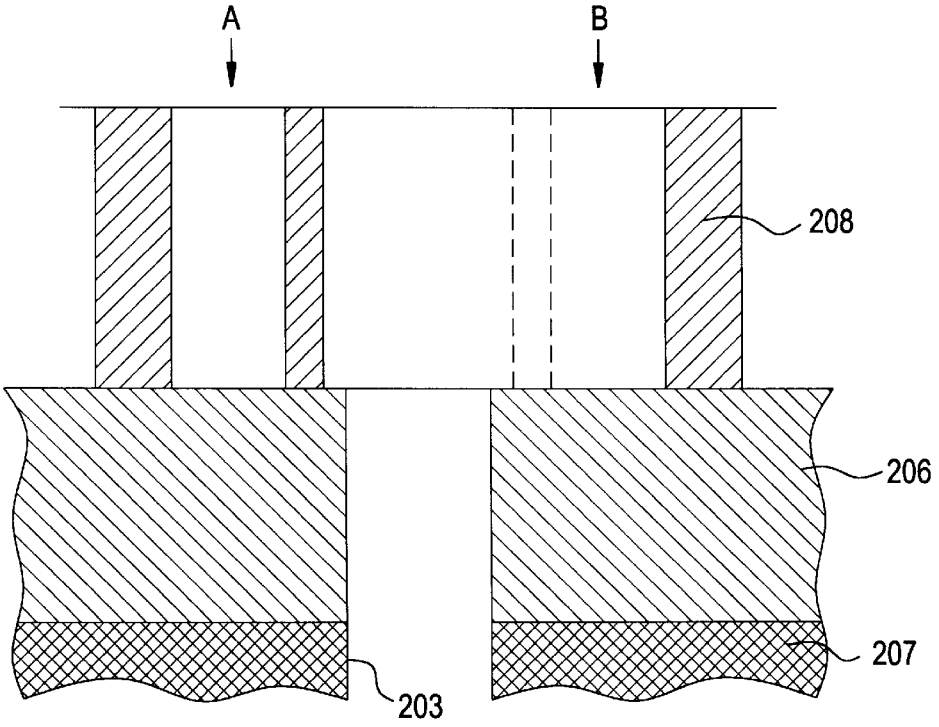

FIG. 22 shows another example. FIG. 22(*a*) shows an upper spinneret disc 208 viewed from the molten metal inlet side; and FIG. 22(*b*) is a cross-sectional view taken along the line Z–Z' in FIG. 22(*a*). In the drawing, the openings 202 and 202' are defined not by pipes but by comb-like openings.

Figure 23A:
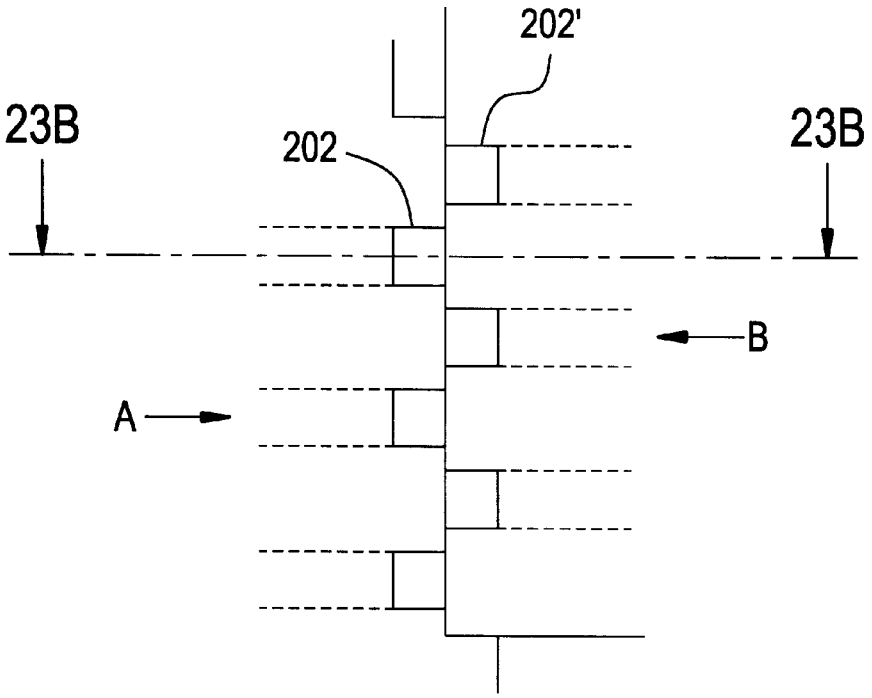
FIG. 23 shows another example of openings in the spinneret for spinning a composite polymer fiber according to the present invention.
Figure 23B:
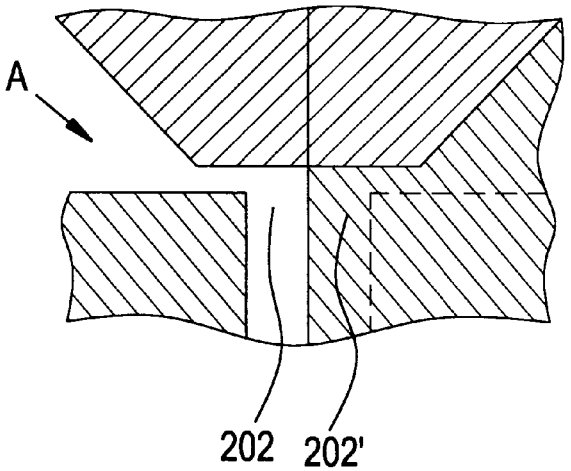
Figure 24A:
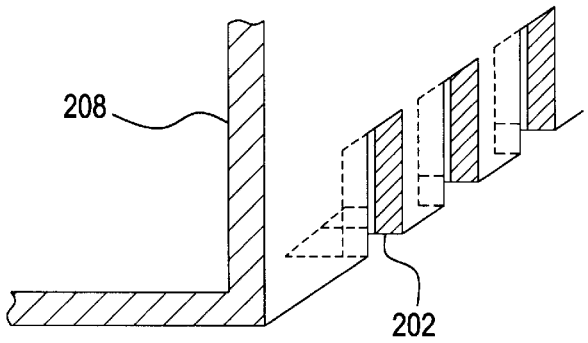
FIG. 24 shows another example of openings in the spinneret for spinning a composite polymer fiber according to the present invention.
Figure 24B:
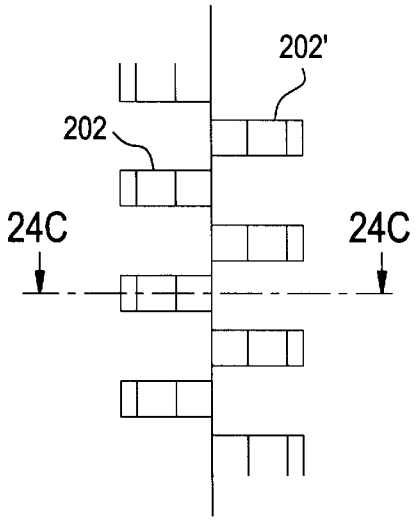
Figure 24C:
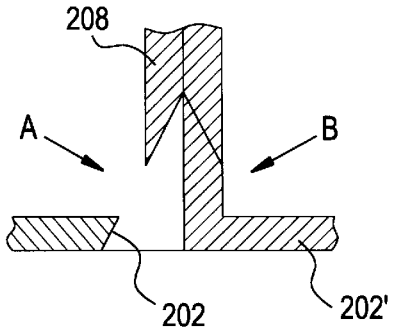

FIGS. 23 and 24 show examples where rows of openings 202 and 202' for injecting molten polymers are not aligned but are arranged in two adjacent rows.

FIG. 23(*a*) shows openings 202 and 202' viewed from the outlet side; and FIG. 23(*b*) is a cross-sectional view taken along the line V–V' in FIG. 23(*a*), in which the molten polymers A and B are laminated alternately after they are injected through the openings 202 and 202' to form a laminated body.

FIG. 24(*a*) is a perspective view of an upper spinneret piece; FIG. 24(*b*) shows a combination of two spinneret pieces shown in FIGS. 24(*a*) viewed from the outlet side; and FIG. 24(*c*) is a cross-sectional view taken along the line W–W' in FIG. 24(*b*).

In the example shown in FIG. 24, the corner formed by two plates brought into contact with each other at right angle is slitted diagonally to form openings 202, as shown in FIG. 24(*a*). Two sets of such right-angled plates are combined so that the openings 202 and 202' may be arranged alternately.

In this example, the molten polymers A and B are laminated alternately after they are injected through the openings 202 and 202' respectively to form a laminated body.

Figure 25:
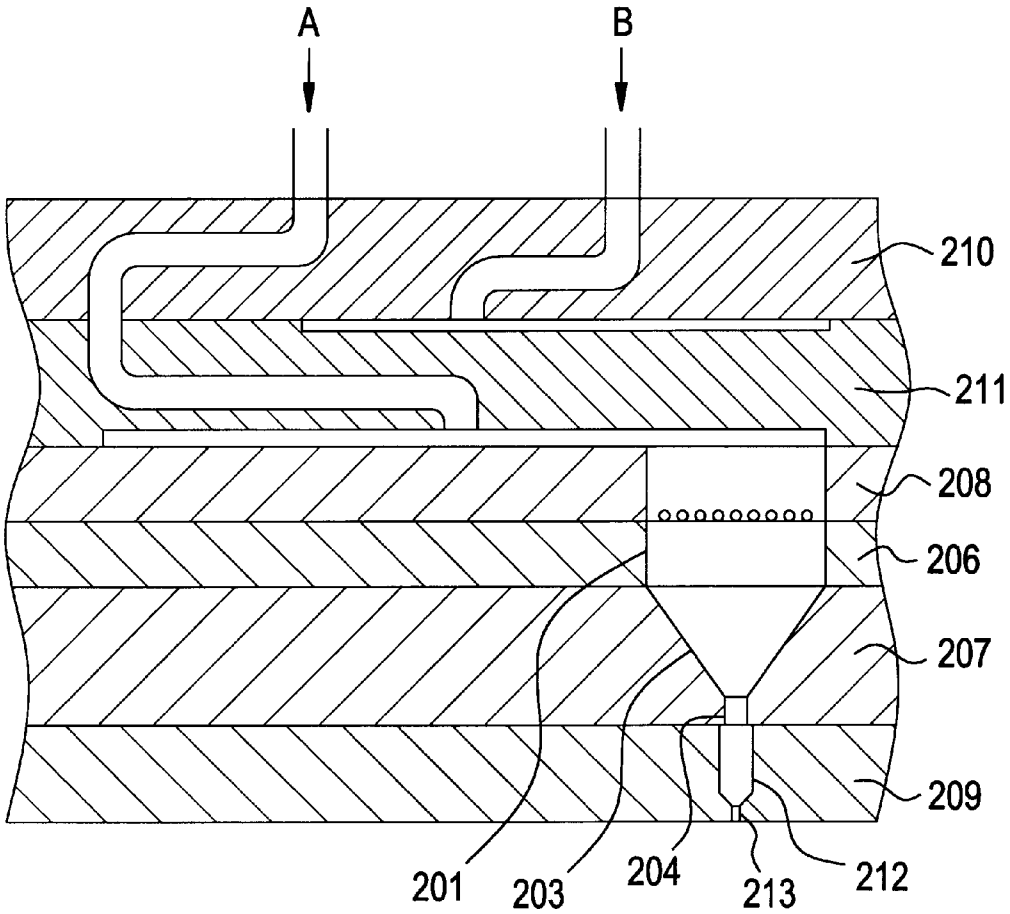
FIG. 25 is a cross-sectional view of a spinneret according to another embodiment of the present invention.
Figure 31A:
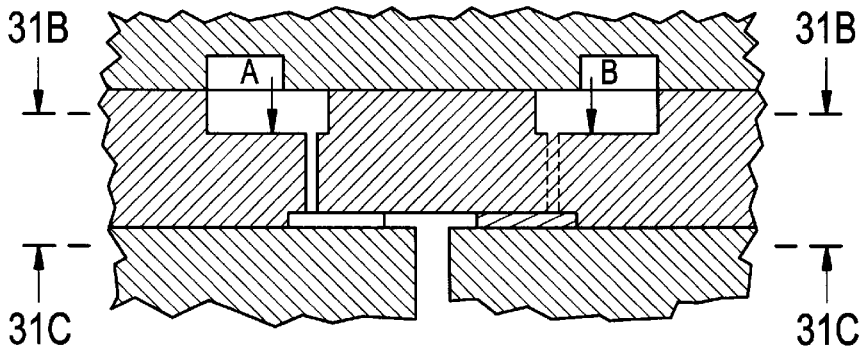
FIG. 31 shows a spinneret for spinning a composite polymer fiber according to another embodiment of the present invention.
Figure 31B:
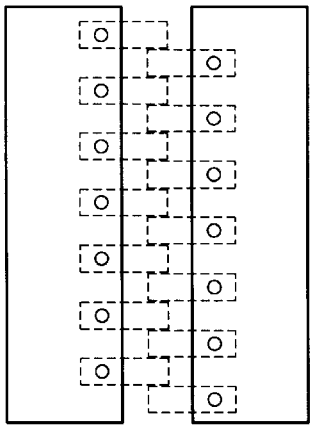
Figure 31C:
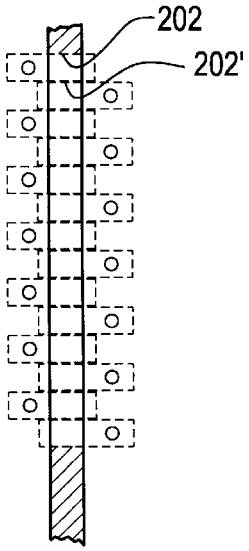
Figure 32A:
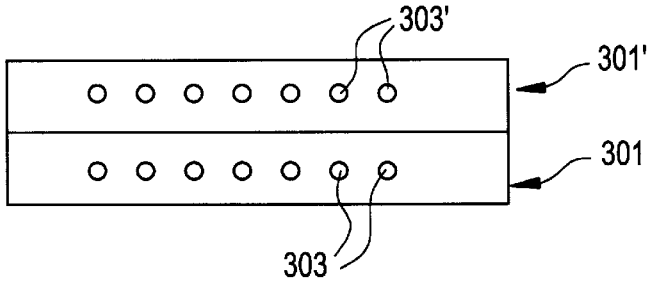
FIG. 32 shows an example of two nozzle plates employable according to the present invention which are combined with each other.
Figure 32B:
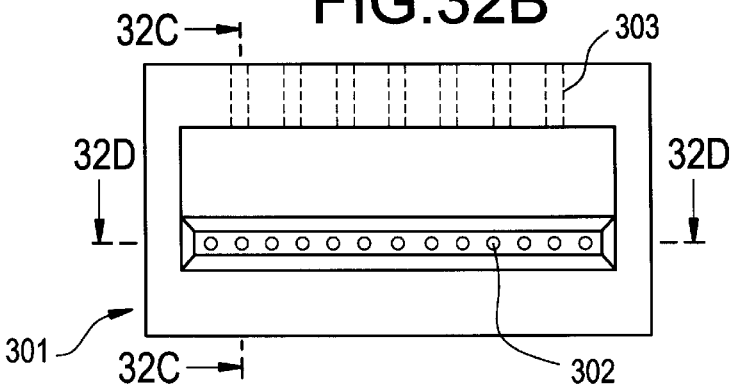
Figure 32C:
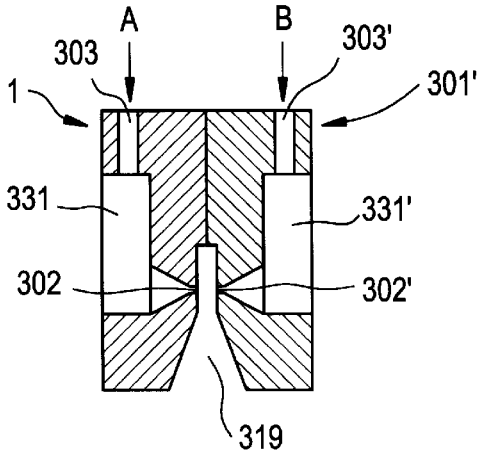
Figure 32D:
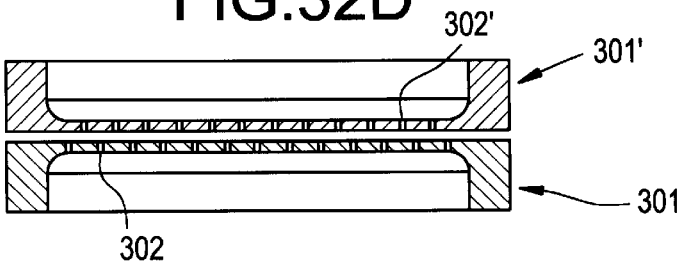

An overall view of a spinneret which can be incorporated with various types of openings 202 and 202' is shown in FIG. 25. The spinneret comprises a combination of an upper spinneret disc 208 incorporated with the openings 202 and 202', an intermediate spinneret disc located under the upper spinneret disc 208 and a lower spinneret disc 207 having a funnel-like portion 203 and a fiber injecting orifice 204, as well as, a bottom disk 209 having a spinneret orifice 213 continuing from the orifice 204 via a channel 212, and an upper distribution disc 210 and a lower distribution disc 211 for distributing the molten polymers A and B to the respective openings which are disposed on the upper spinneret disc 208. There are other examples as shown in FIGS. 31(*a*) to 31 (*c*), in which FIG. 31(*a*) is a vertical cross-sectional view showing a major section of the spinneret; FIG. 31(*b*) is a cross-sectional view taken along the line T–T' in FIG. 31(*a*); and FIG. 3(*c*) is a cross-sectional view taken along the line W–W' in FIG. 31(*a*). The resin A and the resin B flow vertical channels to fill horizontal slit-like channels and are injected through openings 202 and 202', respectively.

Figure 26:
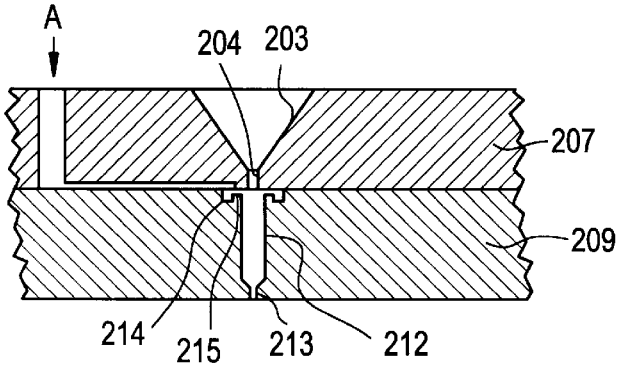
FIG. 26 is a cross-sectional view of a spinneret according to another embodiment of the present invention.
Figure 27A:
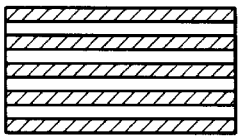
FIG. 27 shows an example of composite polymer fiber to be obtained using a spinneret for spinning a composite polymer fiber according to the present invention.
Figure 27B:
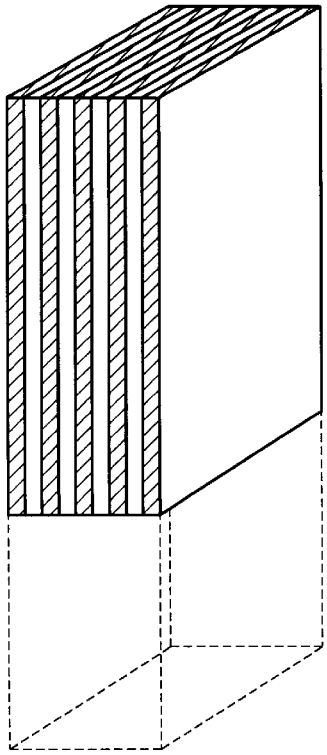
Figure 28:
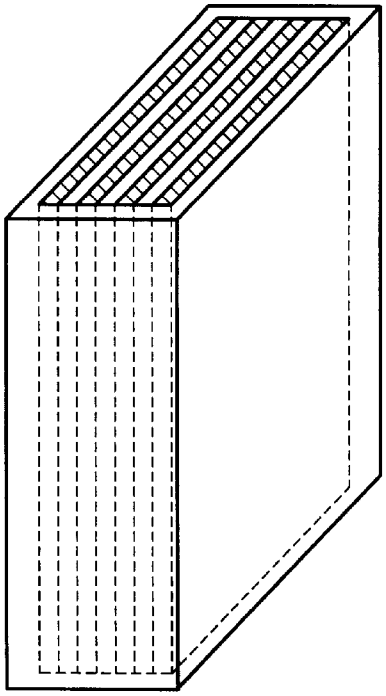
FIG. 28 shows another example of composite polymer fiber to be obtained using a spinneret for spinning a composite polymer fiber according to the present invention.
Figure 29:
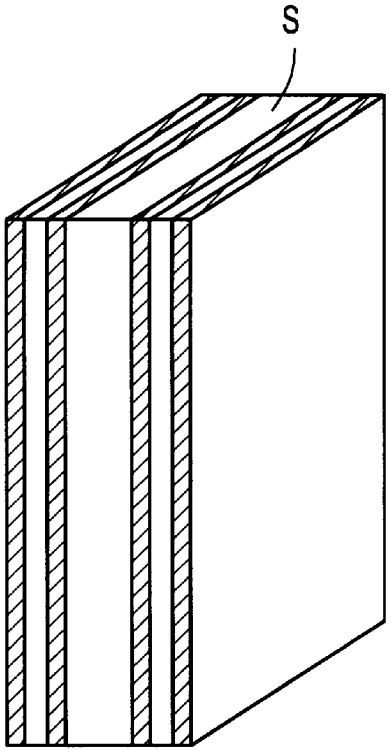
FIG. 29 shows another example of composite polymer fiber to be obtained using a spinneret for spinning a composite polymer fiber according to the present invention.

Further, the bottom disk 209 shown in FIG. 25 may be replaced with a bottom disk 209' shown in FIG. 26, which has an annular groove 214 around a spot where the injection orifice 204 is located above, with a weir-like ridge 215 being formed along the inner circumference of the groove 214. By employing such structure and by supplying one of molten polymers (e.g. polymer A) through a separate channel to the annular groove 214, the molten polymer A filled the annular groove 214 flows over the weir-like ridge 215 into a channel 212 along the circumference thereof In this process, since a layered body of molten polymers injected through the injection orifice 204 flows into the central zone of the channel 212, the fiber to be spun finally through a spinneret orifice 213 comes to have a structure in which the layered body is surrounded with a sheath of one-component polymer, as shown in FIG. 28, so that the layered body is prevented from undergoing layer separation, and thus the strength of the fiber is improved.

TEST EXAMPLE 4

Two kinds of polymer compounds were subjected to spinning using the spinneret shown in FIG. 25 containing openings shown in FIGS. 17(*a*) to 17(*c*), in which the lower spinneret disc 207 and the bottom disc 209 were replaced with those as shown in FIG. 26. Thirty openings 202 and 202' were formed in total (15 each) employing pipes having a bore diameter of 0.3 mm and a wall thickness of 0.1 mm. The final spinneret orifice 213 had dimensions of 0.14 mm (layering direction)×2.1 mm.

Nylon 6 ([η]=1.3) which was employed as one polymer compound was supplied at a rate of 4 g/min; whereas a polyethylene terephthalate copolymerized with 1.5 mol % of sodium sultoisophthalic acid component ([η]=0.48) employed as the other polymer compound was supplied at a rate of 12 g/min. Spinning was carried out at a spinneret temperature of 280° C. to take up the resulting fiber at a spinning rate of 1200 m/min.

Figure 30:
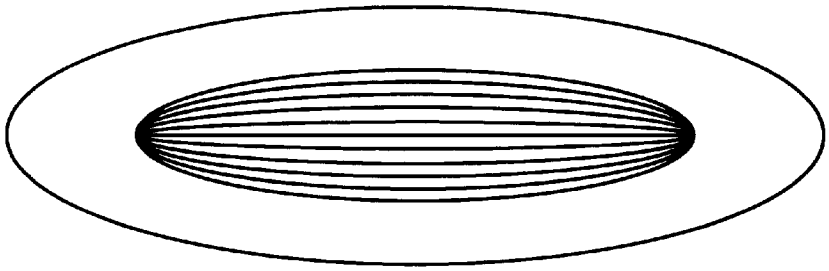
FIG. 30 is a cross-sectional view of a composite polymer fiber obtained in Test Example 4.

The composite polymer fiber thus obtained had a flatness of 4. The fiber was then supplied to rollers heated to 80° C. to be oriented at a draw ratio =2.0. The thus oriented composite polymer fiber had a fineness of 60 denier and a cross-sectional structure as shown in FIG. 30 and showed color development ranging from green to blue.

TEST EXAMPLE 5

A composite polymer fiber was obtained exactly in the same manner as in Test Example 4 except that 30 comb-like openings 202 and 202' in total (15 each) were employed. The plate defining the openings 202 and 202' had a wall thickness of 0.15 mm, and the wall-to-wall intervals of each opening 202 and 202' was 0.2 mm The composite polymer fiber thus obtained had a fineness of 60 denier and a cross-sectional structure as shown in FIG. 30 and showed color development ranging from green to blue.

Figure 33:
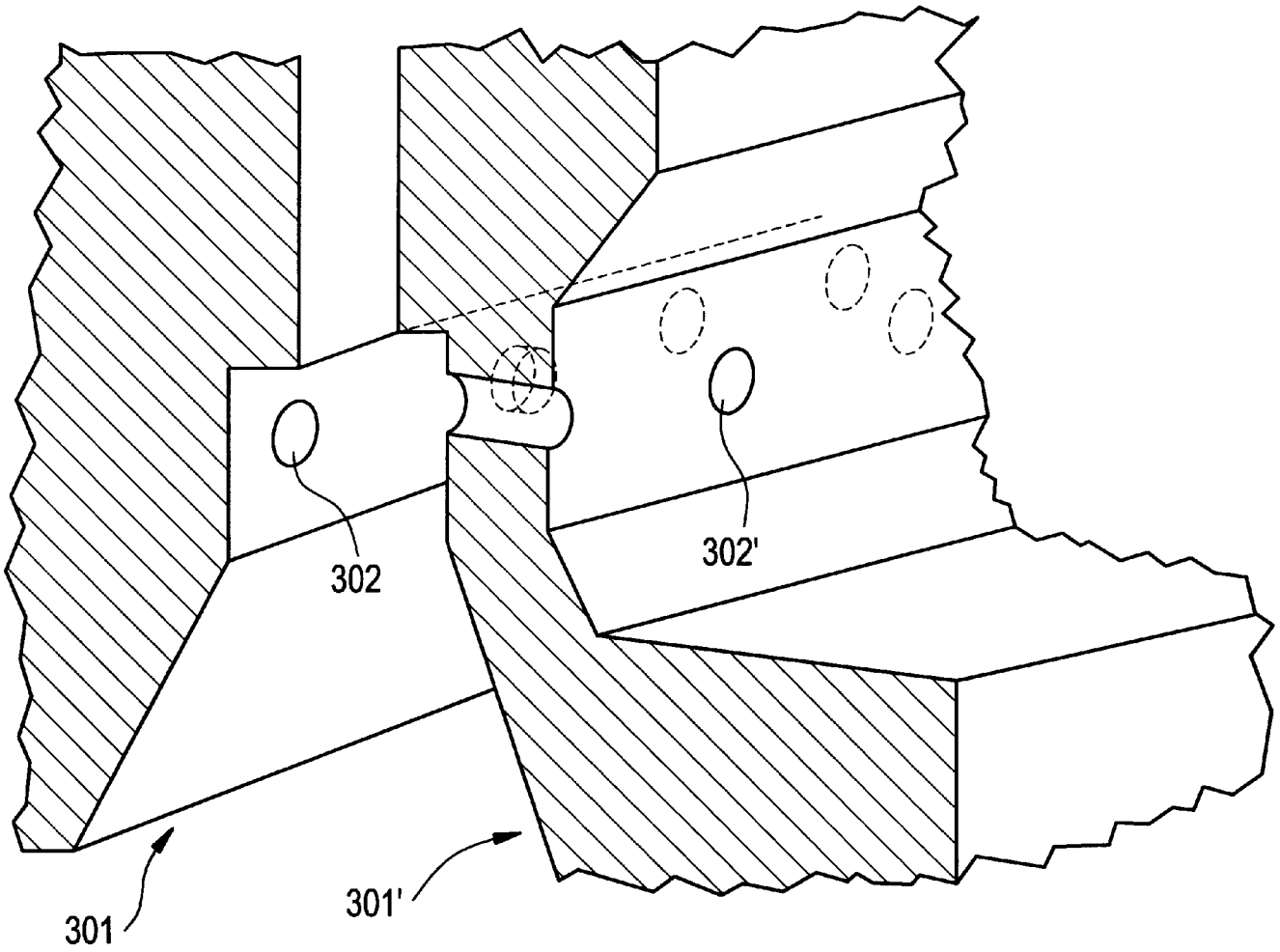
FIG. 33 is a partially cutaway perspective view showing the two nozzle plates shown in FIG. 32 which are spaced a little from each other.

Embodiments of other types of spinneret are shown in FIG. 32 and so forth. FIG. 32 shows a pair of nozzle plates 301 and 301'. FIG. 32(*a*) is a plan view of the pair of nozzle plates 301 and 301' opposed to each other; FIG. 32(*b*) is a front view thereof FIG. 32(*c*) is a cross-sectional view taken along the line X–X' in FIG. 32(*b*); and FIG. 32(*d*) is a cross-sectional view taken along the line Y–Y' in FIG. 32(*b*). Further, FIG. 33 shows a partially cutaway perspective view of the pair of nozzle plates 301 and 301' which are spaced a little from each other.

Molten polymers A and B flow through introduction channels 303 and 303' defined at the tops of the nozzle plates 301 and 301' into nozzle plate chambers 331 and 331' and are injected through rows of openings 302 and 302' defined in the nozzle plates 301 and 301', respectively, to flow into a meeting chamber 319. Since the openings 302 and 302' are arranged alternately, these two molten polymers A and B injected through them form a layered structure, as shown in FIG. 34(*a*), to flow as such into the meeting chamber 319.

Figure 34A:
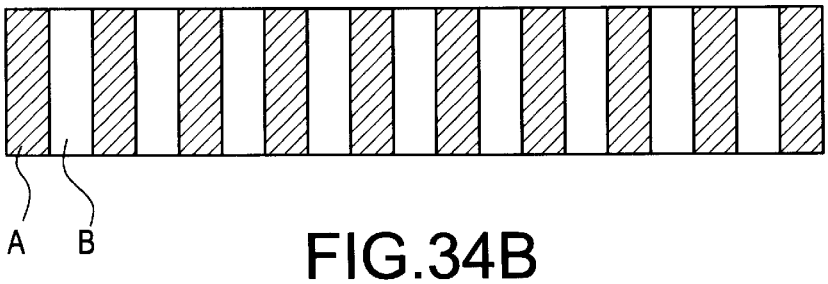
FIG. 34 is a cross-sectional view showing a state of two kinds of molten polymers injected from the nozzle plates shown in FIG. 32 FIG. 34(*a*) is the state immediately after injection.
Figure 34B:
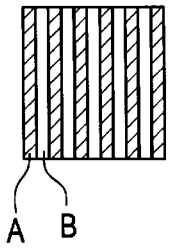
Figure 35:
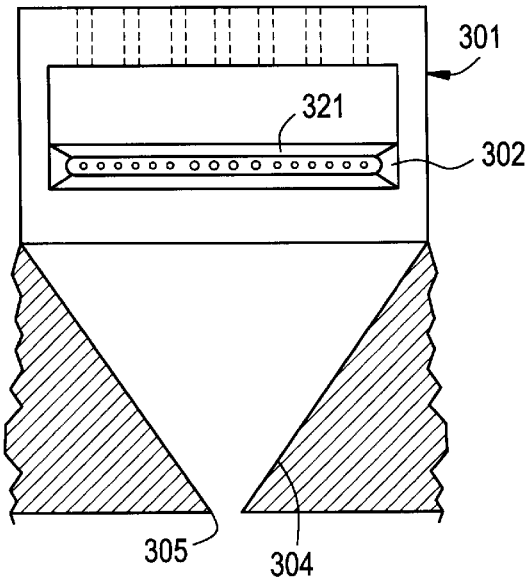
FIG. 35 is a cross-sectional view showing the nozzle plates shown in FIG. 32 and a funnel-like portion formed contiguous thereto taken along the plane containing the joining interface between the nozzle plates.

The channel defined between the nozzle plates 301 and 301' communicates to a funnel-like portion 304 as shown in FIG. 35, and the composite polymer fiber formed by passing the funnel-like portion 304 and a final injection orifice 305 has a structure as shown in FIG. 34(*b*), in which thin films of polymers A and B are layered alternately. Accordingly, the composite polymer fiber can exhibit excellent optical functions.

Figure 49A:
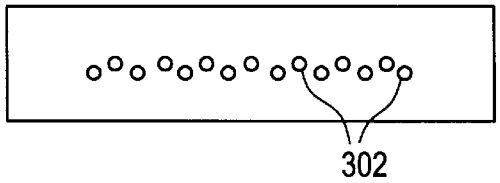
Figure 49B:
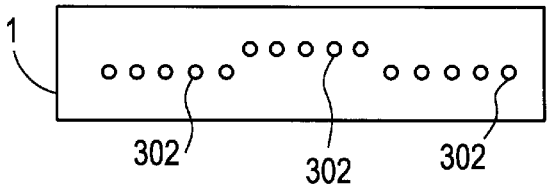

While the openings 302 to be defined in the nozzle plate 301 may have the same bore diameter and may be arranged at regular intervals, openings 321 having a larger diameter may be defined at the central area or the intervals between the openings 302 may be reduced in such area so as to achieve smooth supply of the polymer A for forming the core S. Incidentally, while the openings 302 and 321 are aligned in the example shown in FIG. 35, they may be staggered as shown in FIG. 49(*b*) so as to facilitate machining and the like as described above.

Figure 36:
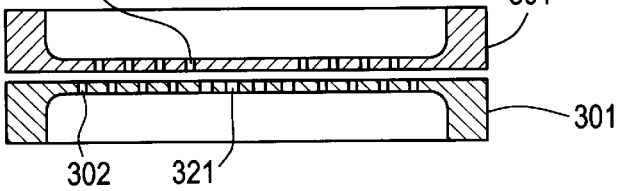
FIG. 36 is a horizontal cross-sectional view showing another example of two nozzle plates taken horizontally across all of the openings.
Figure 45A:
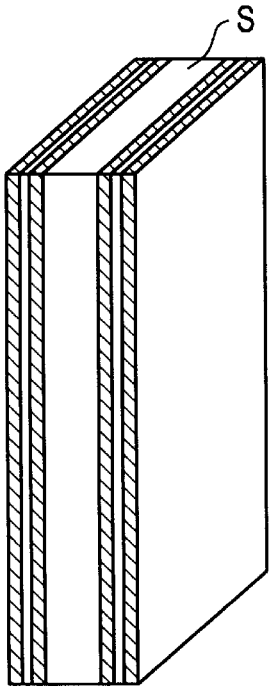
FIG. 45 shows another example of composite polymer fiber to be obtained using a spinneret according to the present invention.
Figure 45B:
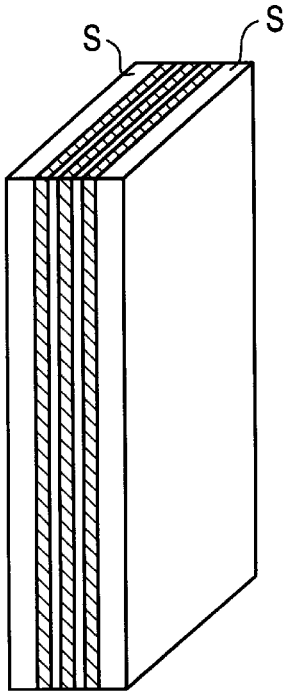

If rows of openings 302, 302' and 321 are defined in the nozzle plates 301 and 301' as shown in FIGS. 35 and 36, a composite polymer fiber having a core S of the polymer A, as shown in FIG. 45(*a*) can be obtained. This composite polymer fiber having the core S is preferred since the core S improves the mechanical strength of the fiber.

Figure 37:
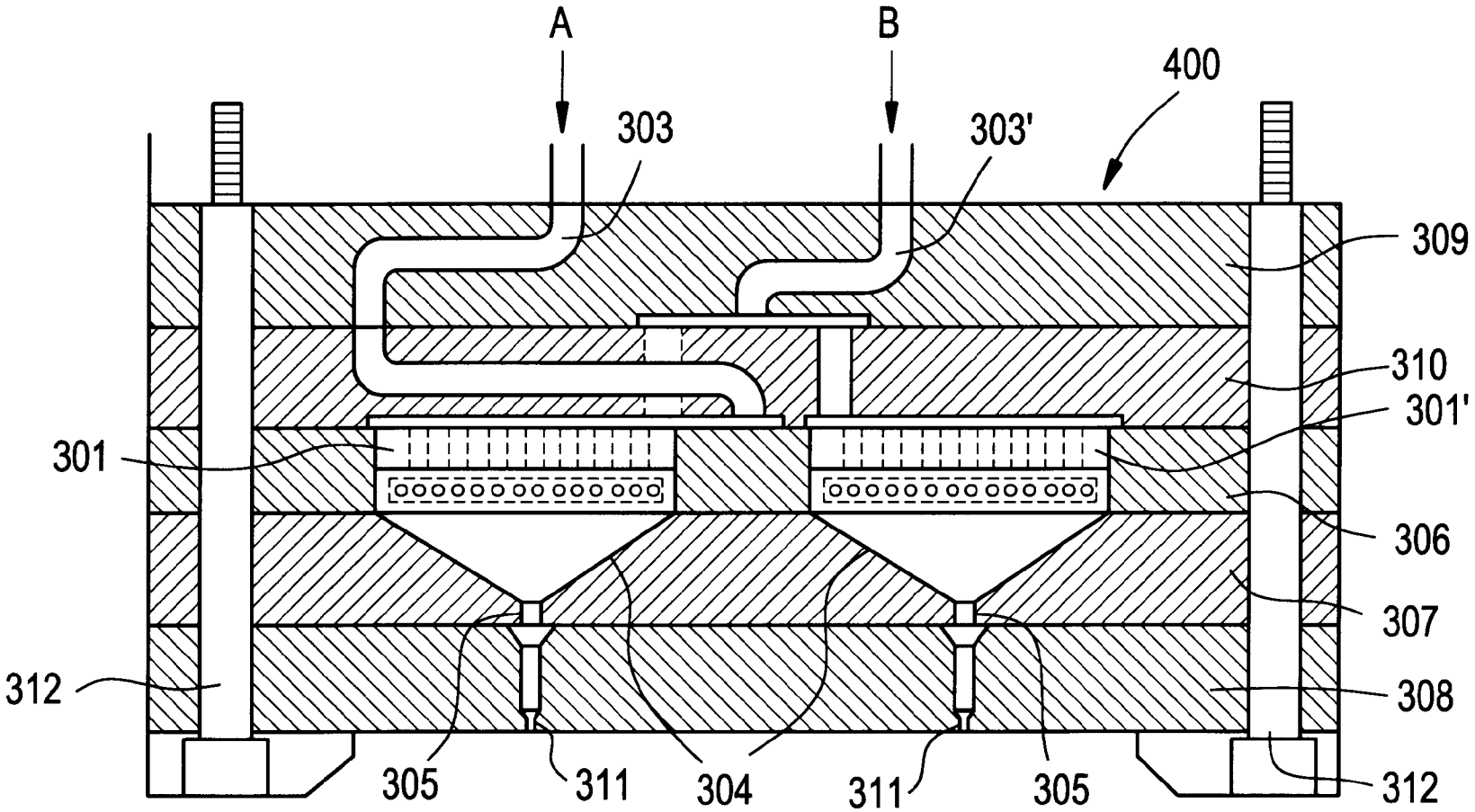
FIG. 37 is a vertical cross-sectional view showing a spinneret according to another embodiment of the present invention.
Figure 38:
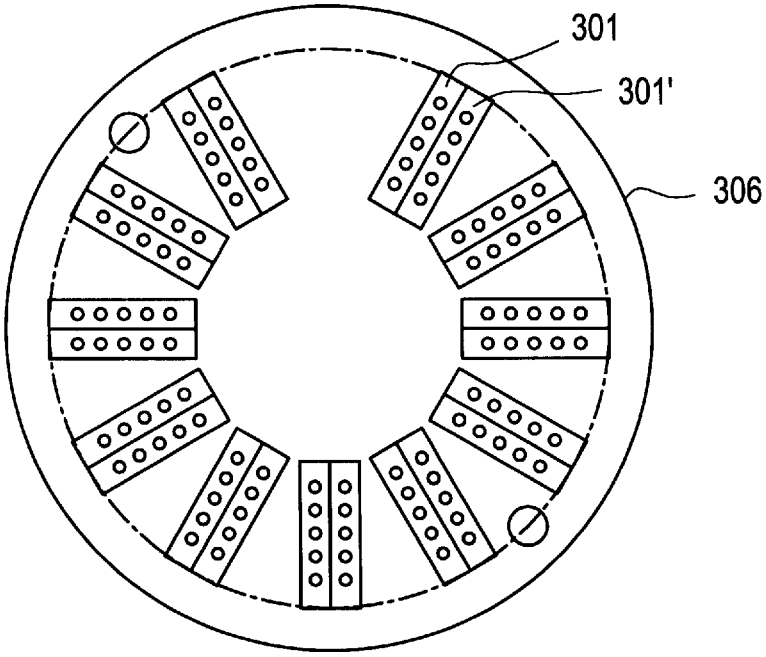
FIG. 38 is horizontal cross-sectional view showing a spinneret according to the present invention taken across the upper part of the upper spinneret disc.

An actual spinneret 400 incorporated with such nozzle plates 301 and 301' is shown in FIG. 37. The spinneret 400 consists of an upper distribution disc 309, a lower distribution disc 310, an upper spinneret disc 306, an intermediate spinneret disc 307 and a lower spinneret disc 308 which are fastened with bolts 312. A multiplicity of nozzle plates 301 and 301' are set radially on the upper spinneret disc 306, as shown in FIG. 38, and the same numbers of channels 303 and 303' as that of the nozzle plate pairs 301 and 301' are defined in the upper distribution disc 309 and the lower distribution disc 310 so as to supply molten polymers A and B to each pair of nozzle plates 301 and 301'. Further, the same numbers of funnel-like portions 304 and final spinneret orifice 311 as that of the nozzle plate pairs 301 and 301' are defined in the intermediate spinneret disc 307 and lower spinneret disc 308 so as to allow a composite polymer fiber formed through each pair of nozzle plates 301 and 301' to have a structure as shown in FIG. 34(*b*).

The molten polymer A is distributed through the channels 303 defined in the upper distribution disc 309 and lower distribution disc 310 to each nozzle plate 301, while the molten polymer B is likewise distributed through the channels 303' to each nozzle plate 301'. Subsequently, the molten polymers A and B injected through the nozzle plates 301 and 301' are layered, and then the thickness of each layer is reduced in the funnel-like portions 304 to be spun through final spinneret orifices 311.

Figure 39:
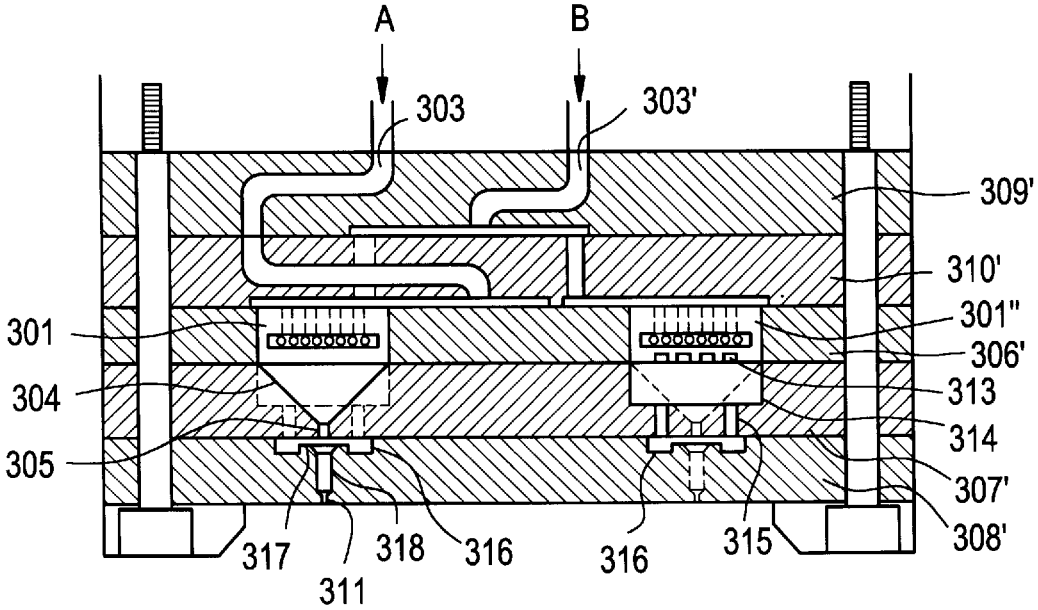
FIG. 39 is a vertical cross-sectional view showing a spinneret according to another embodiment of the present invention.
Figure 40A:
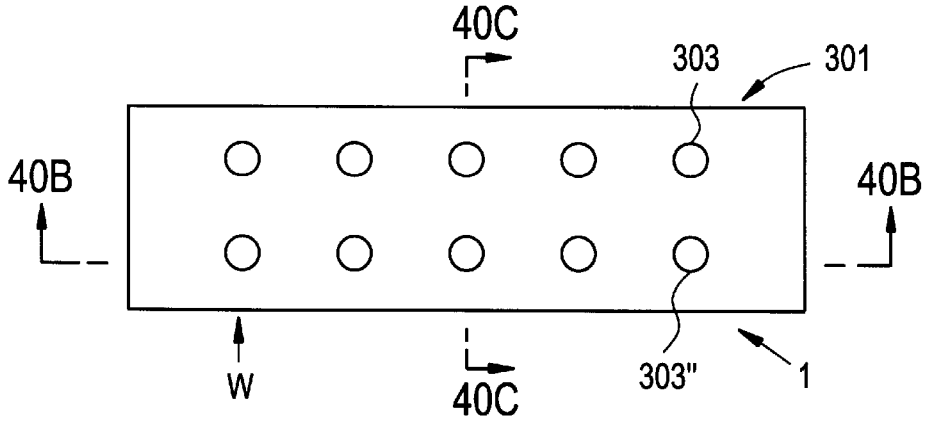
FIG. 40 shows a pair of nozzle plates according to another example of the present invention.
Figure 40B:
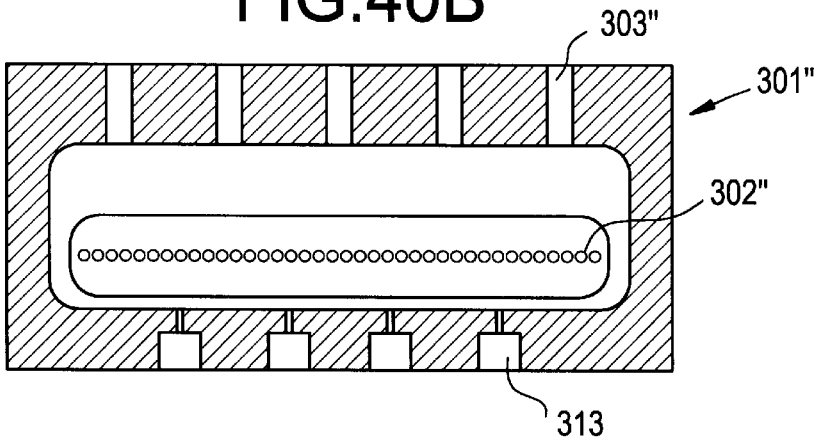
Figure 40C:
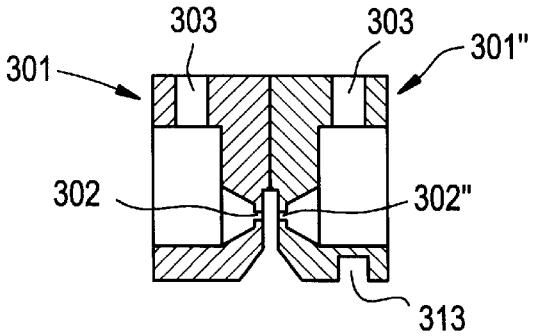
Figure 41:
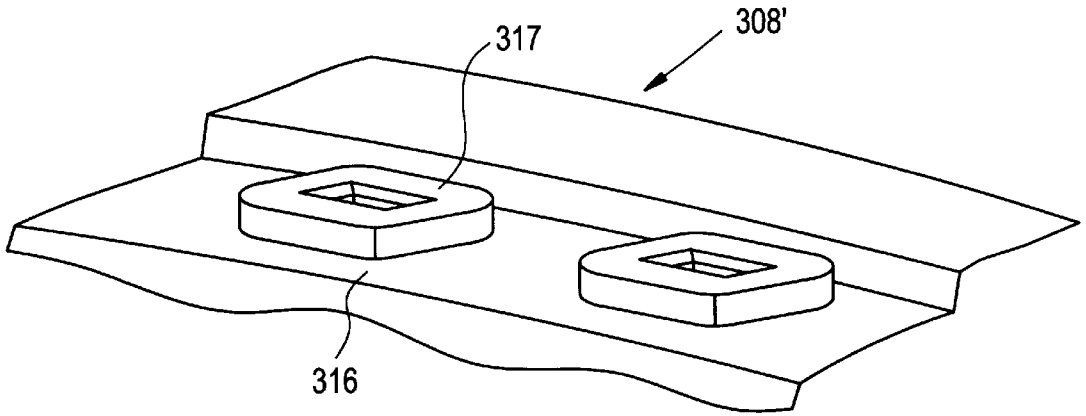
FIG. 41 is a partially cutaway perspective view showing an upper surface of an intermediate spinneret 308' according to another embodiment of the present invention.

Net, other embodiments of the present invention will be described referring to FIGS. 39, 40 and 41. FIG. 39 is a vertical cross-sectional view showing a spinneret according to another embodiment of the present invention. FIG. 40(*a*) is a plan view showing a pair of nozzle plates 301 and 301"; FIG. 40(*b*) a cross-sectional view taken along the line W–W' in FIG. 40(*a*); and FIG. 40(*c*) is a cross-sectional view taken along the line Z–Z'. FIG. 41 is an enlarged perspective view showing the upper surface of the lower spinneret disc 308'.

A multiplicity of nozzle plate pairs 301 and 301" in this embodiment are set radially in the spinneret as illustrated in FIG. 38. Each nozzle plate 301" contains, in addition to openings 302", supply ports 313" for supplying the molten polymer B downward, and channels 314 and 315 for supplying the molten polymer B are defined in the intermediate spinneret disc 307' below the supply ports 313.

Figure 46:
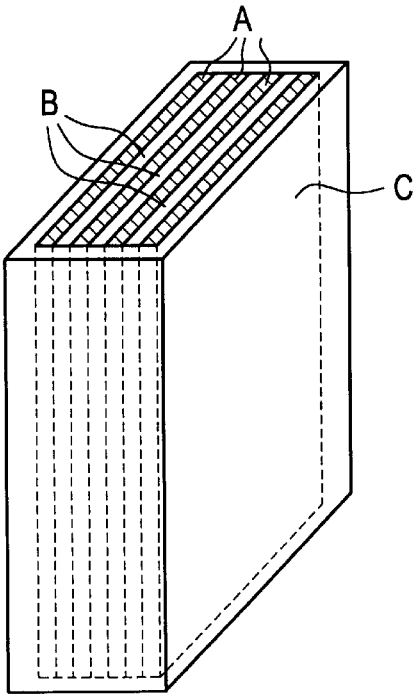
FIG. 46 shows another example of composite polymer fiber to be obtained using a spinneret according to the present invention.

Further, an annular groove 316 as shown in FIG. 41 is formed on the upper surface of the lower spinneret disc 308', and weir-like ridges 317 are formed to be opposed to injection orifices 305 of the intermediate spinneret disc 307' respectively. The molten polymer B passed through the channels 315 fills the annular groove 316 to flow over the upper surfaces of weir-like ridges 317 into channels 318. Since a layered body of the molten polymers A and B injected through each injection orifice 305 flows into the central zone of each channel 318, the molten polymer B flowed over the weir-like ridge 317 surrounds the layered body to form a sheath therearound, and the composite polymer fiber to be spun finally out of each spinneret orifice 311 assumes a structure as shown in FIG. 46, in which thin films of molten polymers A and B are layered alternately, and the layered body is surrounded with a sheath-like frame C.

Figure 42:
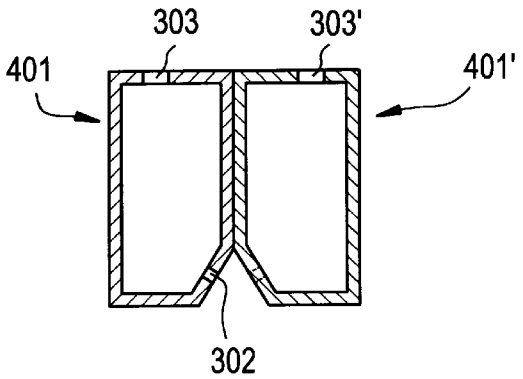
FIG. 42 is a cross-sectional view showing another example of nozzle plates employable according to the present invention.

As another embodiment, the nozzle plates having the configurations shown in FIG. 32(*c*) may be replaced with those having the configurations, as shown in FIG. 42, in which openings 302 are oriented diagonally. In this embodiment, the nozzle plates are opposed in such a way that they may be brought into contact with each other on the upstream side to form an inverted V-shaped section on the downstream side. Nozzle plates which can together form such a V-shaped section are convenient, since they can be produced and assembled easily.

Figure 43:
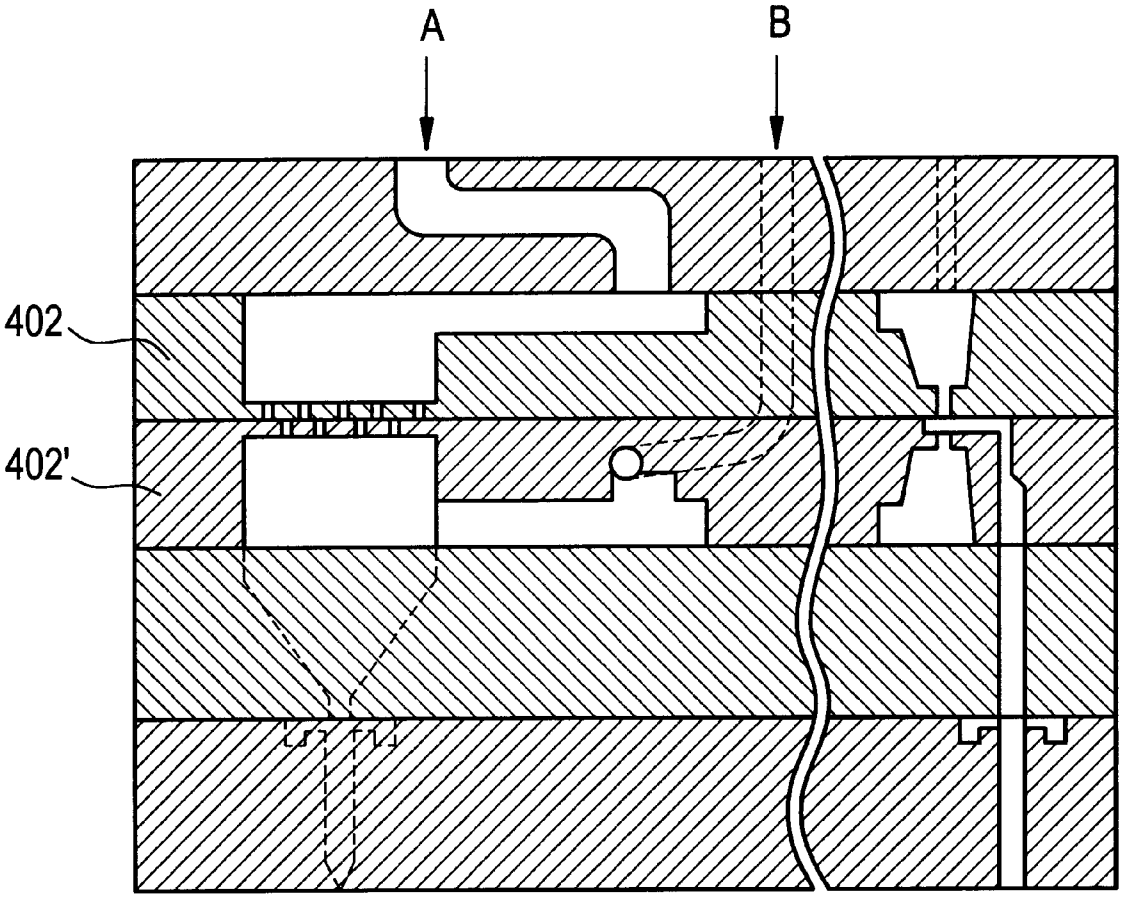
FIG. 43 is a cross-sectional view showing a spinneret according to another embodiment of the present invention.

Further, the nozzle plates may not necessarily be oriented vertically, and two nozzle plates 402 and 402' oriented horizontally may be combined with each other in the vertical relationship as shown in FIG. 43. In this case, the molten polymer A is supplied to the upper nozzle plate 402, while the molten polymer B is supplied to the lower nozzle plate 402', and the molten polymers A and B are injected at the interface between the nozzle plates 402 and 402' through respective openings arranged alternately.

Figure 44A:
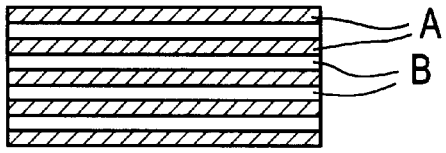
FIG. 44 shows another example of composite polymer fiber to be obtained using a spinneret according to the present invention.
Figure 44B:
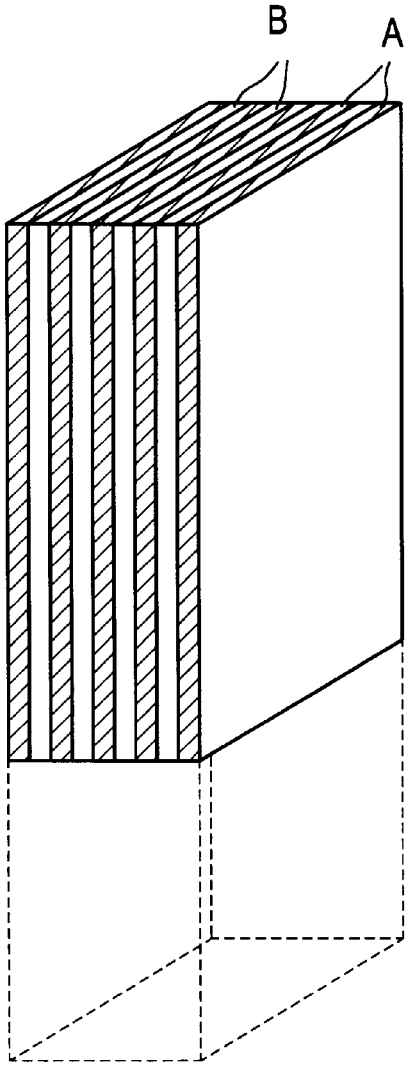
Figure 50:
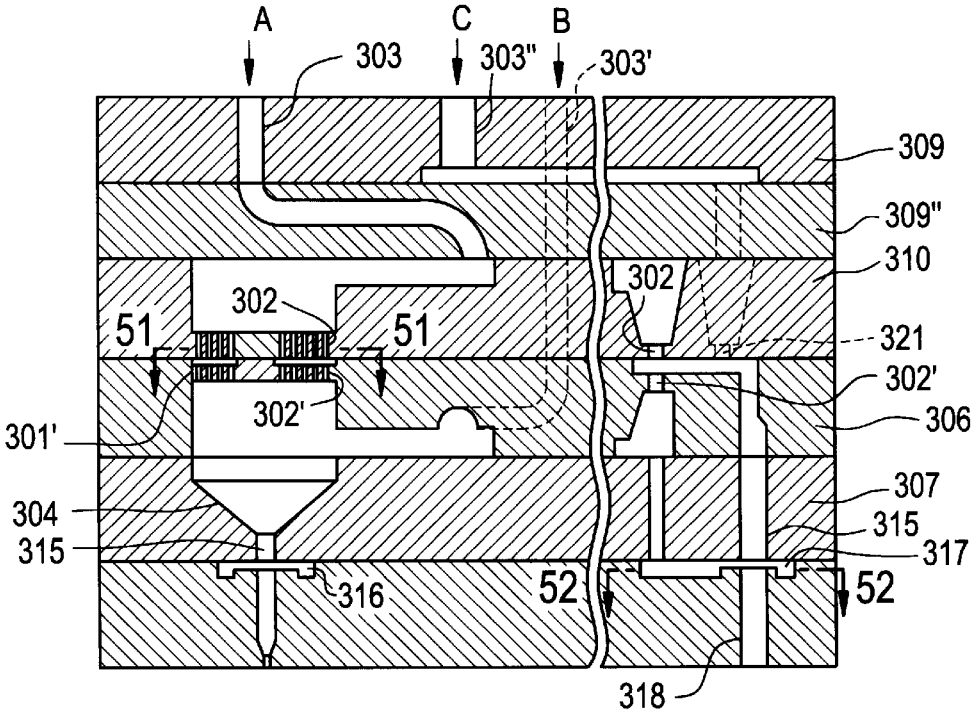
FIG. 50 is a vertical cross-sectional view showing a spinneret according to another embodiment of the present invention.
Figure 51:
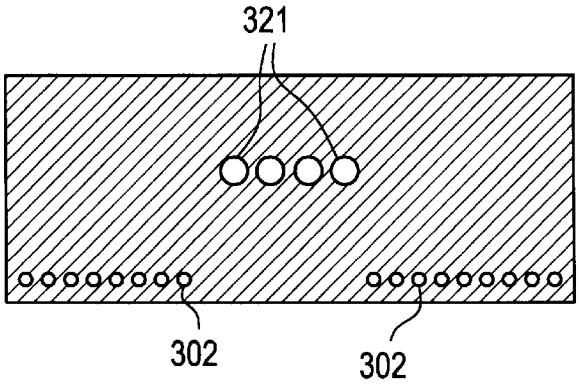
FIG. 51 is a cross-sectional view taken along the line X–X' in FIG. 50.
Figure 52:
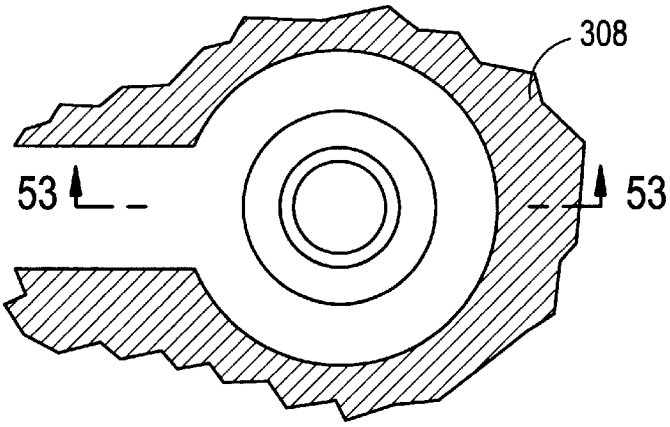
FIG. 52 is a cross-sectional view taken along the line Y–Y' in FIG. 50.
Figure 53:
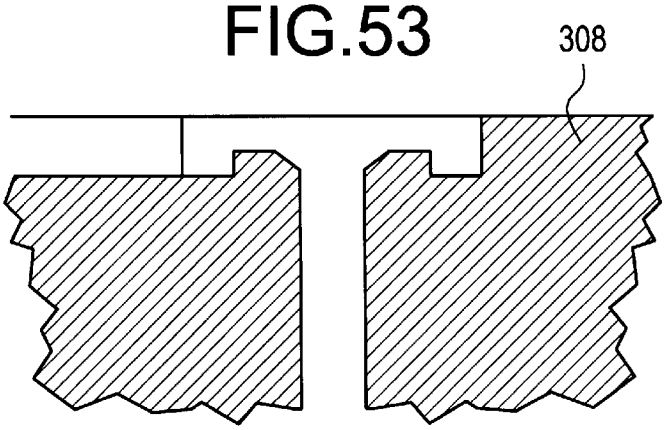
FIG. 53 is a cross-sectional view taken along the line Z–Z' in FIG. 52.

As a further embodiment of the present invention, a composite polymer fiber to be spun out of three kinds of polymer compounds will be described referring to FIGS. 50 to 53. In the spinneret shown in FIG. 50, a pair of nozzle plates 301 and 301' are combined with each other in the vertical relationship. In this embodiment, an upper spinneret disc 310 and a lower distribution disc 306 constitute nozzle plates 301 and 301' respectively. The cross-sectional view taken along the line X–X' in FIG. 50 is as shown in FIG. 51, in which rows of openings 302 are staggered from a row of openings 321. The cross-sectional view taken along the line Y–Y' in FIG. 50 is as shown in FIG. 52, and the cross-sectional view taken along the line Z–Z' in FIG. 52 is as shown in FIG. 53. In this spinneret, molten polymers A and B are passed through pipes 303 and 303' to be introduced to the nozzle plates 301 and 301' and are injected through openings 302 and 302', respectively. Simultaneously, a molten polymer C supplied through introduction pipe 303 is injected through openings 321, and these three molten polymers A, B and C are combined and passed through a funnel-like portion 304 to assume a structure as shown in FIG. 44(*a*).

Figure 54:
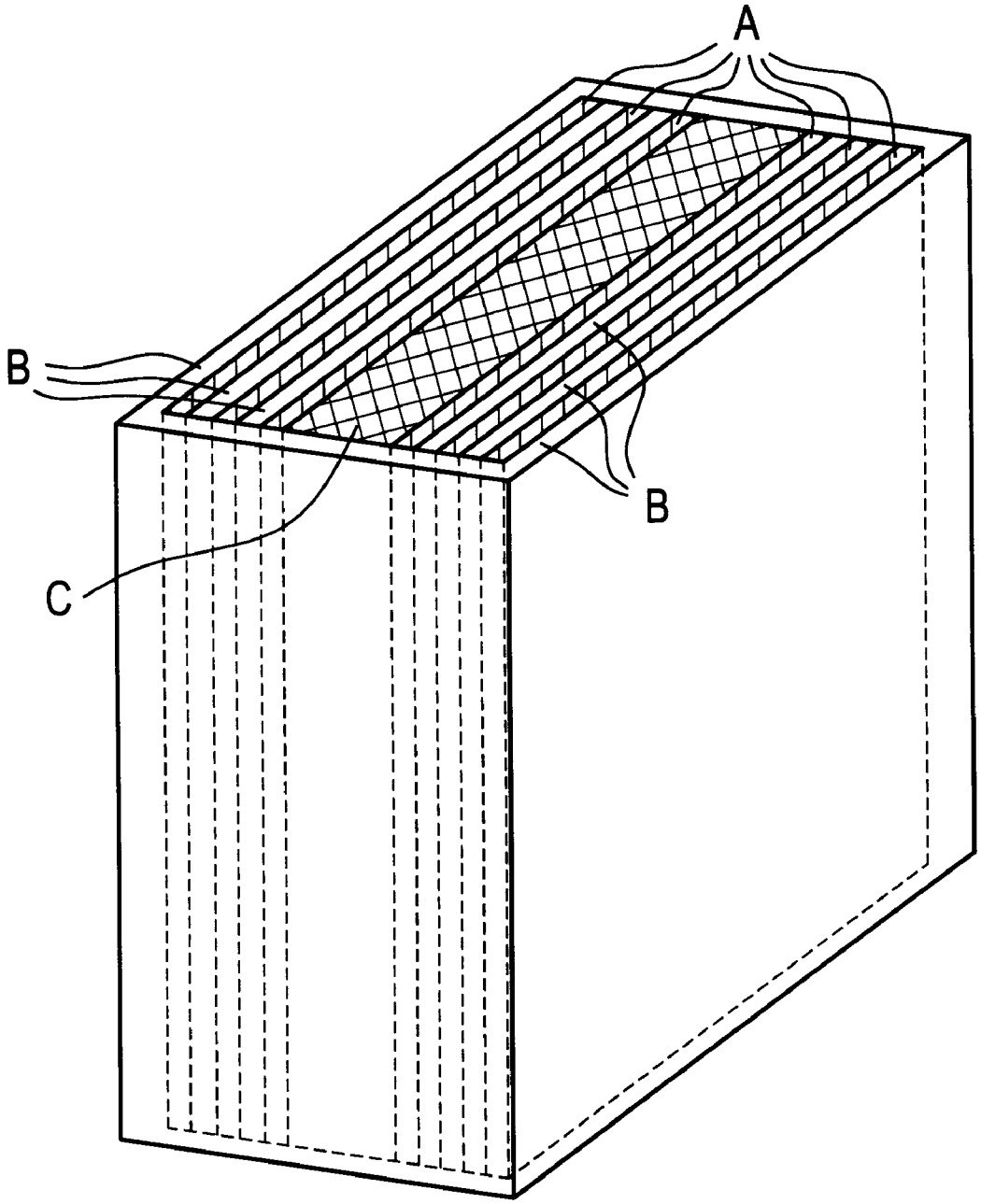
FIG. 54 shows another example of composite polymer fiber to be obtained using a spinneret according to the present invention.

Subsequently, the molten polymer B is partly introduced to an annular groove 316 and flows over the upper surface of a weir-like ridge 317 into a channel 318 where it surrounds a fiber injected through a channel 315 to give a fiber as shown in FIG. 54. In the composite polymer fiber having such a structure, since layered bodies are surrounded with a sheath of one-component polymer, the layered bodies are prevented from undergoing layer separation, so that the strength of the fiber is improved.

TEST EXAMPLE 6

Two kinds of polymer compounds were subjected to spinning using the spinneret shown in FIGS. 35 to 38. Sixteen openings 302 having a bore diameter of 0.203 mm and sixteen openings 302' having a bore diameter of 0.2 mm were defined at a pitch of 0.5 mm. Four openings 321 having a bore diameter of 0.35 mm were defined at a pitch of 0.75 mm. Eleven pairs of nozzle plates 301 and 301' were set radially in the spinneret as shown in FIG. 38. The clearance secured between each pair of nozzle plates 301 and 301' was 0.2 mm, with a tapered channel having an increasing clearance from 0.2 mm to 2.5 mm being defined on the downstream side of the nozzle plates (see FIG. 32(*c*)), which is connected on the downstream side to a taper 304 narrowing in the direction perpendicular to the nozzle plate opposing direction, as shown in FIG. 35. The final spinneret orifice 311 had dimensions of 0.13 mm×2.5 mm.

Figure 47:
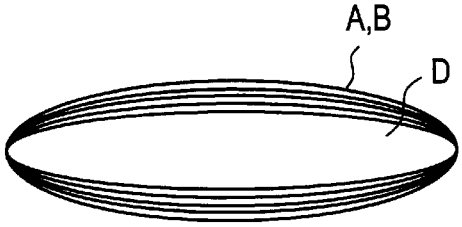
FIG. 47 is a cross-sectional view showing another example of composite polymer fiber obtained according to the process of the present invention.

Nylon 6 ([η]=1.3) was used as the polymer compound to be supplied to the nozzle plate 301 and supplied at a rate of 12 g/min. A polyethylene terephthalate copolymerized with 1.5 mol % of sodium sullbisophthalic acid component ([η]=0.48) was used as the polymer compound A and supplied at a rate of 8 g/min. Spinning was carried out at a spinneret temperature of 280° C. to take up the resulting fiber at a spinning rate of 1500 m/min. The fiber had a flatness of 5.5. The fiber was then supplied to rollers heated to 80° C. to be oriented at a draw ratio of 2.0. The thus oriented composite polymer fiber had a flat cross-sectional structure, as shown in FIG. 47, having a core D at the center of a layered structure consisting of the molten polymers A and B and showed color development ranging from red to green.

TEST EXAMPLE 7

Figure 48:
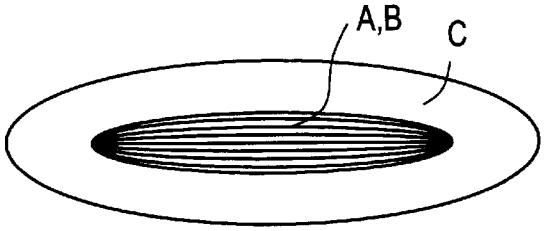
FIG. 48 is a cross-sectional view showing a composite polymer fiber obtained according to another embodiment of the process of the present invention.

Two kinds of polymer compounds were subjected to spinning using the spinneret shown in FIGS. 39 to 41. A row of 31 openings 302 and a row of 30 openings 302" each having a bore diameter of 0.2 mm were formed respectively. The procedures of Test Example 6 were repeated analogously except that the same polyethylene terephthalate as used in Test Example 6 was supplied as one polymer compound to the openings 302, and nylon 306 was supplied as the other polymer compound to the openings 302". The resulting composite polymer fiber had a flat cross-sectional structure, as shown in FIG. 48, having a sheath C surrounding a layered structure of the molten polymers A and B and showed color development ranging from green to blue. Incidentally, a fiber of a structure having both a core D and a sheath C can be obtained if the nozzle plates 301 and 301' as shown in FIG. 36 are incorporated into the spinneret shown in FIG. 37.

TEST EXAMPLE 8

Two kinds of polymer compounds were subjected to spinning using the spinneret shown in FIGS. 39 to 41. As the polymer compounds a copolymerized polyethylene terephthalate and nylon 6 were employed. The reason why the copolymerized polyethylene terephthalate was used here rather than ordinary polyethylene terephthalate is that the former has higher compatibility with nylon 6, so that separation of it from nylon 6 can be prevented. Spinning was carried out typically as described below.

To a reactor were charged 1.0 mol of dimethyl terephthalate, 2.5 mol of ethylene glycol and 5-sulfoisophthalic acid. Further, 0.0008 mol of calcium acetate and 0.0002 mmol of manganese acetate, which were employed as ester exchange catalysts, were also charged to the reactor. The resulting mixture was heated gradually to 150 to 230° C. with stirring to effect ester exchange reaction. After a predetermined amount of methanol was separated from the reaction system, 0.0012 mol of antimony trioxide was added as a polymerization catalyst to the system, and heating and pressure reduction were carried out gradually while occurring ethylene glycol was extracted until the phase came to have a temperature of 285° C. and a degree of vacuum of 1 Torr. These conditions were maintained for further increase in the viscosity, and the reaction was quenched at the time point when the torque applied to a stirrer reached a predetermined level. The resulting compound was extruded into water to give pellets of copolymerized polyethylene terephthalate (PET). The PET thus obtained has an intrinsic viscosity of 0.47 to 0.64. As the second substance, nylon 6 (intrinsic viscosity=1,3) described above was employed These two kinds of organic polymer pellets were subjected to spinning using the spinneret shown in FIGS. 38 to 40. Specifications of the spinneret were the same as in Test Example 7, and the copolymerized polyethylene terephthalate was supplied to the openings 302 at a rate of 30.5 mg/min, and nylon 6 was supplied to the openings 302" at a rate of 4.5 mg/min. When these polymers were subjected to spinning at a spinning rate of 1000 m/min, a filament yarn having a flatness of 4.8 was obtained, and the filament yarn was then subjected to 3.0-fold orientation over a roller type drawing machine to give a 100 denier/11 filament oriented yarn. This flat yarn had a cross-sectional structure, as shown in FIG. 48, and there was observed absolutely no layer separation. This flat yarn showed color development with a clear peak at 1 mm. Thickness of each copolymerized terephthalate layer and that of each nylon 6 layer were measured at the central point of the layered structure and at the point of ⅛ the length thereof from one end to determine average thickness values, respectively. The polyethylene terephthalate layers had an average thickness of 0.156 mm, and the nylon 6 layers had an average thickness of 0.163 mm.

TEST EXAMPLE 9

Polyethylene terephthalate and nylon 6 as two kinds of polymer compounds were subjected to spinning likewise employing the spinneret shown in FIGS. 38 and 40. In order to increase compatibility with nylon 6 and to prevent separation from nylon 6, polyethylene terephthalate was blended with sodium alkylbenzenesulfonate as a compatibilizer, and the resulting blend was pelletized.

A flat yarn having a flatness of 5.2 was obtained using these two kinds of organic polymer pellets in the same manner as in Test Example 8. When thickness of each layer was determined like in Test Example 8, the polyethylene terephthalate layers had an average thickness of 0.154 μm and the nylon 6 layers had an average thickness of 0.160 μm. No layer separation was observed in this flat yarn, either.

TEST EXAMPLE 10

Three kinds of polymer compounds were subjected to spinning using the spinneret shown in FIGS. 50 to 53. Twelve pairs of nozzle plates were arranged radially as shown in FIG. 38, and 16×2 openings 302 having a bore diameter of 0.15 mm were defined per nozzle plate to which polyethylene terephthalate was supplied, while 15×2 openings 302' having a bore diameter of 0.15 mm were defined per nozzle plate to which nylon was supplied. Further, four openings 321 having a bore diameter of 0.4 mm were defined, and a mixture of polyethylene terephthalate and an oxide was supplied to each opening 321. The polymers were supplied at a rate of 30 g/min, and spinning was carried out at a spinneret temperature of 275° C. to take up the resulting fiber at a spinning rate of 1500 mm/min. The draw ratio of the fiber was 2.0, and the resulting fiber bad a cross-sectional area of 15 μm×75 μm and a flatness of 5 and also had a structure as shown in FIG. 54. The fiber showed color development ranging from green to blue, and the fiber developed bright colors, by virtue of the oxide incorporated into the polymer constituting the core C, compared with those having transparent cores C.

It should be apparent to those skilled in the art that the present invention may be embodied in many other specific forms without departing from the spirit or scope of the invention. Therefore, the present examples and embodiments are to be considered as illustrative and not restrictive, and the invention is not to be limited to the details given herein, but may be modified within the scope of the appended claims.

What is claimed is:

1. A spinneret for spinning a composite polymer fiber using at least two kinds of polymer compounds, comprising:

a channel in the form of a belt to which said polymer compounds are supplied, and from which the polymer compounds are discharged unmixed in the form of a belt flow consisting of strips of the polymer compounds arranged in an alternating manner; and a portion in the form of a funnel consisting of tapered inner faces reducing downward and a rectangular injection orifice formed at a lower end of the portion, from which the belt flow of the polymer compounds supplied from the channel is discharged in the form of a composite polymer fiber containing multiple layers of the polymer compounds, which is compressed such that the thickness of the belt flow is longer than the width thereof and the layers of the polymer compounds are parallel to the longer axis of the fiber.

2. The spinneret according to claim 1, wherein the channel is provided with a plurality of openings, defined in a row orthogonal to the flowing direction of the channel, for injecting therethrough another component polymer compound into the channel; the portion is formed with reducing faces by increasing the depth of the channel and reducing the width thereof gradually on the downstream side of the openings, while the injection orifice assumes the form of a rectangular slit having a cross-sectional profile in which a shorter axis is parallel to the polymer laminating direction and a longer axis is orthogonal to that direction.

3. The spinneret according to claim 2, wherein the channel assumes the form of a comb at a location upstream of the openings defined in a row orthogonal to the channel in the form of a comb are located between gaps in the channel in the form of a comb.

4. The spinneret according to claim 2, wherein the openings in the channel are present only at both ends or at the central zone of the channel.

5. The spinneret according to claim 2, wherein the portion contains a first channel surrounded at the lower end of the portion with a second channel, and the first and second channels are then combined into a single third channel.

6. The spinneret according to claim 3, wherein the portion contains a first channel surrounded at the lower end of the portion with a second channel, and the first and second channels are then combined into a single third channel.

7. The spinneret according to claim 4, wherein the portion contains a first channel surrounded at the lower end of the portion with a second channel, and the first and second channels are then combined into a single third channel.

8. The spinneret according to claim 1, wherein the channel is defined by openings for injecting one of the polymer compounds and openings for injecting another polymer compound which are arranged alternately in a row at pre-determined intervals; the portion is formed with the reducing faces by increasing the depth of the channel and reducing the width thereof gradually on the downstream side of the openings, while the injection orifice assumes the form of a rectangular slit having a shorter axis parallel to the polymer laminating direction and a longer axis orthogonal to that direction.

9. The spinneret according to claim 1, wherein the channel is defined by openings for injecting one of the polymer compounds and openings for injecting another polymer compound which are arranged alternately in two adjacent rows at pre-determined intervals; the portion is formed with the reducing faces by increasing the depth of the channel and reducing the width thereof gradually on the downstream side of the openings , while the injection orifice assumes the form of a rectangular slit having a shorter axis parallel to the polymer laminating direction and a longer axis orthogonal to that direction.

10. The spinneret according to claim 8, wherein the row of openings is defined by cutting a plurality of pipes arranged at predetermined intervals.

11. The spinneret according to claim 9, wherein the row of openings is defined by cutting a plurality of pipes arranged at predetermined intervals.

12. The spinneret according to claim 8, wherein the row of openings is defined by a pair of comb-shaped openings which are meshed with each other by their teeth, and the comb-shaped openings are closed at junctions thereof.

13. The spinneret according to claim 8, wherein the portion contains a first channel surrounded at the lower end of the portion with a second channel, and the first and second channels are then combined into a single third channel.

14. The spinneret according to claim 9, wherein the portion contains a first channel surrounded at the lower end of the portion with a second channel, and the first and second channels are then combined into a single third channel.

15. The spinneret according to claim 10, wherein the portion contains a first channel surrounded at the lower end of the portion with a second channel, and the first and second channels are then combined into a single third channel.

16. The spinneret according to claim 11, wherein the portion contains a first channel surrounded at the lower end of the portion with a second channel, and the first and second channels are then combined into a single third channel.

17. The spinneret according to claim 12, wherein the portion contains a first channel surrounded at the lower end of the portion with a second channel, and the first and second channels are then combined into a single third channel.

18. The spinneret according to claim 1, wherein the channel is defined by a pair of nozzle plates each containing a row of openings for injecting a polymer compound which row of openings is opposed to each other such that the openings of one plate and the openings of the other plate are arranged alternately; the portion is formed with reducing faces by increasing the depth of the channel and reducing the width thereof gradually on the downstream side of the openings, while the injection orifice assumes the form of a rectangular slit having a cross-sectional profile in which a shorter axis is parallel to the polymer laminating direction and a longer axis is orthogonal to that direction.

19. The spinneret according to claim 18, wherein nozzle plates are opposed parallel to each other so that the polymer compounds injected from the openings of the respective nozzle plates meet and are combined with each other.

20. The spinneret according to claim 18, wherein the nozzle plates are opposed parallel to each other such that they are brought into contact with each other on the upstream side thereof to form an inverted V-shaped section on the downstream side and the polymer compounds to be injected from the openings of these nozzle plates are injected diagonally downward and combined with each other.

21. The spinneret according to claim 18, wherein one nozzle plate contains a continuous row of openings and the other nozzle plate contains openings only at both ends or at the central area thereof.

22. The spinneret according to claim 19, wherein one nozzle plate contains a continuous row of openings and the other nozzle plate contains openings only at both ends or at the central area thereof.

23. The spinneret according to claim 20, wherein one nozzle plate contains a continuous row of openings and the other nozzle plate contains openings only at both ends or at the central area thereof.

24. The spinneret according to claim 18, wherein the portion contains a first channel surrounded at the lower end of the portion with a second channel, and the first and second channels are then combined into a single third channel.

25. The spinneret according to claim 19, wherein the portion contains a first channel surrounded at the lower end of the portion with a second channel, and the first and second channels are then combined into a single channel.

26. The spinneret according to claim 21, wherein the portion contains a first channel surrounded at the lower end of the portion with a second channel, and the first and second channels are then combined into a single third channel.

27. The spinneret according to claim 21, wherein the portion contains a first channel surrounded at the lower end of the portion with a second channel, and the first and second channels are then combined into a single third channel.

28. The spinneret according to claim 22, wherein the portion contains a first channel surrounded at the lower end of the portion with a second channel, and the first and second channels are then combined into a single third channel.

29. The spinneret according to claim 23, wherein the portion contains a first channel surrounded at the lower end of the portion with a second channel, and the first and second channels are then combined into a single third channel.

* * * * *